US006904948B2

(12) United States Patent
Auger et al.

(10) Patent No.: US 6,904,948 B2
(45) Date of Patent: Jun. 14, 2005

(54) CELLULAR SHADE MATERIAL FOR COVERINGS FOR ARCHITECTURAL OPENINGS

(75) Inventors: Raymond Auger, Aspen, CO (US); Gary Ashurst, Ft. Collins, CO (US); Cliff Birch, Summerfield, NC (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 10/444,821

(22) Filed: May 22, 2003

(65) Prior Publication Data

US 2004/0065416 A1 Apr. 8, 2004

Related U.S. Application Data

(60) Provisional application No. 60/383,346, filed on May 24, 2002.

(51) Int. Cl.[7] ..... E06B 9/08

(52) U.S. Cl. ..... 160/121.1; 160/84.05; 428/116

(58) Field of Search ..... 160/84.05, 84.04, 160/121.1, 120, 122, 113; 428/116, 118; 156/197

(56) References Cited

U.S. PATENT DOCUMENTS 5,503,210 A 4/1996 Colson et al. ..... 160/84.05
5,547,006 A 8/1996 Auger ..... 160/84.01
6,033,504 A * 3/2000 Judkins ..... 156/70
6,206,075 B1 * 3/2001 Prince et al. ..... 160/84.05
6,513,565 B1 * 2/2003 Rupel et al. ..... 160/84.05
6,630,222 B1 * 10/2003 Fay et al. ..... 428/118
6,688,369 B2 * 2/2004 Colson et al. ..... 160/121.1

* cited by examiner

*Primary Examiner*—Blair M. Johnson
(74) *Attorney, Agent, or Firm*—Dorsey & Whitney LLP

(57) ABSTRACT

An apparatus and method for fabricating a cellular roller shade material for use in roller shade coverings for architectural openings is described. In a preferred embodiment, two fabric tapes are joined proximate an edge of each to form a wide fabric tape. The wide fabric tape is then pulled through a folding horn to fold the tape along a longitudinal axis that is laterally offset from the tape's longitudinal axis. Two longitudinal adhesive beads are applied to the folded tape by an adhesive applicator. The folded tape is then continuously wound onto tubular surface with the surfaces of the folded tape containing the adhesive beads being placed in an overlapping relationship with a portion of a previously wrapped section of the folded tape. The wrapped and joined tubular tape is cut to form a sheet of shade material that comprises plurality of horizontally-extending cells when utilized in a roller shade.

10 Claims, 37 Drawing Sheets

CELLULAR SHADE MATERIAL FOR COVERINGS FOR ARCHITECTURAL OPENINGS

CROSS-REFERENCE TO RELATED APPLICATION

This application is a non-provisional application which claims the benefit of U.S. provisional application Ser. No. 60/383,346, filed May 24, 2002, which application is incorporated by reference herewith in its entirety.

BACKGROUND OF THE INVENTION

1. Field of the Invention

This invention relates generally to a fabrication apparatus and method for fabricating coverings for architectural openings. More specifically, the invention relates to a fabrication apparatus and method for fabricating cellular material from fabric tape for use in roller shade coverings.

2. Background Description

Roller shades are well known in the art and typically comprise a fabric shade material that hangs down from a roller and has a foot rail attached to its bottom edge. The roller is typically contained in a head rail that is attached to a vertical surface. As desired the shade material can be rolled up onto the roller to expose the architectural opening (typically, a window) beneath it.

In general, the shade material must be capable of being rolled up relatively tightly onto the roller so that the roller and the retracted shade can fit into the recesses of the head rail. It is possible that larger head rails could be utilized with a roller shade utilizing thick shade material, however, the head rail would likely be obtrusive and not aesthetically pleasing. Accordingly, the material used for roller shades is almost always flat. Typically, roller shade materials will be comprised of one or two layers of fabric. When two layers are utilized, a front fabric is typically specified for its aesthetic properties and the backing fabric for its light handling characteristics or its ability to withstand ultraviolet light without fading.

In the recent past coverings for architectural openings that utilize a cellular shade material have become very popular. The cellular shade material provides a measure of space between the back side of the shade and the front side. Like roller shade materials the backing fabrics may be specified for their light handling characteristics while the front fabrics may be chosen for aesthetic reasons. Cellular shades offer several advantages over roller shades. First, they handle light in a more aesthetically pleasing manner than two similar front and backing materials can when they are placed directly on top of each other. Second, the cells formed from the spacing between the fabrics create a dead air space that provides desirable insulating properties.

Cellular shades are typically expensive to manufacture, and in some instances the lift mechanisms require lift cords that are threaded through the interior of the cells. Conversely, roller shades do not utilize lift cords and have the entire lift mechanism contained within the roller. Fabrication of a roller shade typically comprises cutting the shade material to size, attaching a roller and foot rail to the material and attaching the roller to a head rail.

BRIEF SUMMARY OF THE INVENTION

An apparatus and method for fabricating a cellular roller shade material are described.

In a first embodiment, an apparatus for fabricating the cellular roller shade material includes one or more adhesive applicators that are configured to apply continuous adhesive beads to a fabric tape that is at least partially folded over onto itself along a longitudinal fold line. The one or more applicators are arranged such that the one adhesive bead is laterally spaced from the other adhesive bead. The apparatus further includes an elongated tubular surface on which the fabric tape is continuously wrapped in an overlapping arrangement perpendicularly to the longitudinal length of the surface. One or more drive motors are also provided for rotating the tubular surface at one speed while moving the tubular surface longitudinally at another speed, wherein the two speeds are proportional to each other in a predetermined ratio.

Variations of the first embodiment also include a roller biased against the tubular surface for compacting the fabric tape against the tubular surface and the section of fabric tape it overlaps. Another variation includes a folding guide for folding the fabric tape along the longitudinal fold line. In yet another variation, one or more spindles are provided on which roll(s) of fabric tape are placed. One variation includes another adhesive applicator and a pressure applicator, wherein two fabric tapes are joined together by an adhesive bead applied to one tape by the other adhesive applicator that is pressed against the other tape by the pressure applicator. When more than one fabric tape is utilized to make a single wider tape, one or more tensioning mechanisms may be provided to ensure that the tension levels between the constituent tapes are the same.

In another embodiment, an apparatus for fabricating the cellular roller shade material includes a mechanism for folding a fabric tape along a longitudinal fold line, a mechanism for positioning the folded tape onto another section of folded tape in a partially overlapping arrangement and a mechanism for joining the overlapping tapes together along two longitudinal seams. In variations of this embodiment, a supply mechanism and a second joining mechanism are provided to supply and join two constituent fabric tapes to form the fabric tape utilized by the folding and positioning mechanisms.

In another embodiment, a method for fabricating the cellular shade is described. First, a fabric tape is folded along a longitudinal fold line to form top and bottom sides. The folded tape is then positioned over another section of folded tape in an overlapping relationship and the two tapes are joined together. Typically, the top and bottom sides of one section of tape proximate the free longitudinal edges of the sides are both joined to either the top or bottom side of the other folded fabric tape section. In variations of the fabrication method, two constituent fabric tapes are joined together to create the fabric tape used in the above-described operations.

In yet another embodiment, a cellular shade material is described. The material comprises two or more adjacent, parallel longitudinally-extending folded fabric tapes. Each tape has a front side and a back side that are connected along a longitudinal fold line. Each side also terminates at a longitudinally-extending edge and has inside and outside surfaces. The back side of each tape has a lateral length that is greater than the lateral length of the front side. The inside surface of the backside of one fabric tape is joined to the outside surface of the backside of another adjacent tape along a longitudinally-extending seam that is located proximate the longitudinally-extending edge of the backside of the one fabric tape. Additionally, the outside surface of the front side of the one fabric tape is joined to the outside surface of the backside of the other fabric tape along another longitudinally extending seam that is located proximate the longitudinally-extending fold line of the other tape. In variations of the cellular shade material the seams include thermoplastic or thermosetting adhesives.

DETAILED DESCRIPTION OF THE INVENTION

An apparatus and method for fabricating cellular fabric from fabric tape for use in roller shade coverings is described. As used herein fabric tape refers to both woven and non-woven fibrous fabrics as well as films. In a preferred embodiment, the fabrication apparatus adhesively joins two fabric tapes as supplied from separate rolls of tape together along overlapping longitudinal edges. Next, the resulting joined tape is folded longitudinally along a line offset a relatively small distance from the adhesive seam and the longitudinal centerline of the joined tape. Additional adhesive is then applied to the bottom side of the folded combined tape along two longitudinal lines. Finally, the bottom side of the folded tape is laid against a drum or a conveyor belt that is rotating or moving in a direction generally parallel with the longitudinal orientation of the folded tape. As the folded tape is being placed, the two adhesive beads are brought into contact with the top sides of a previously laid section of the tape proximate the open edges of the previously laid tape section, thereby longitudinally joining the tape with the previously laid section. The tape is continuously wrapped onto the drum or conveyor belt to produce a tube of cellular roller shade fabric comprised of the spiraling folded tape. Once a tube of sufficient length is created or the drum is substantially covered, the fabrication apparatus is stopped and the cellular shade material is cut transversely to the longitudinal orientation of the folded tape to create a flat sheet of cellular shade material.

Figure 1:
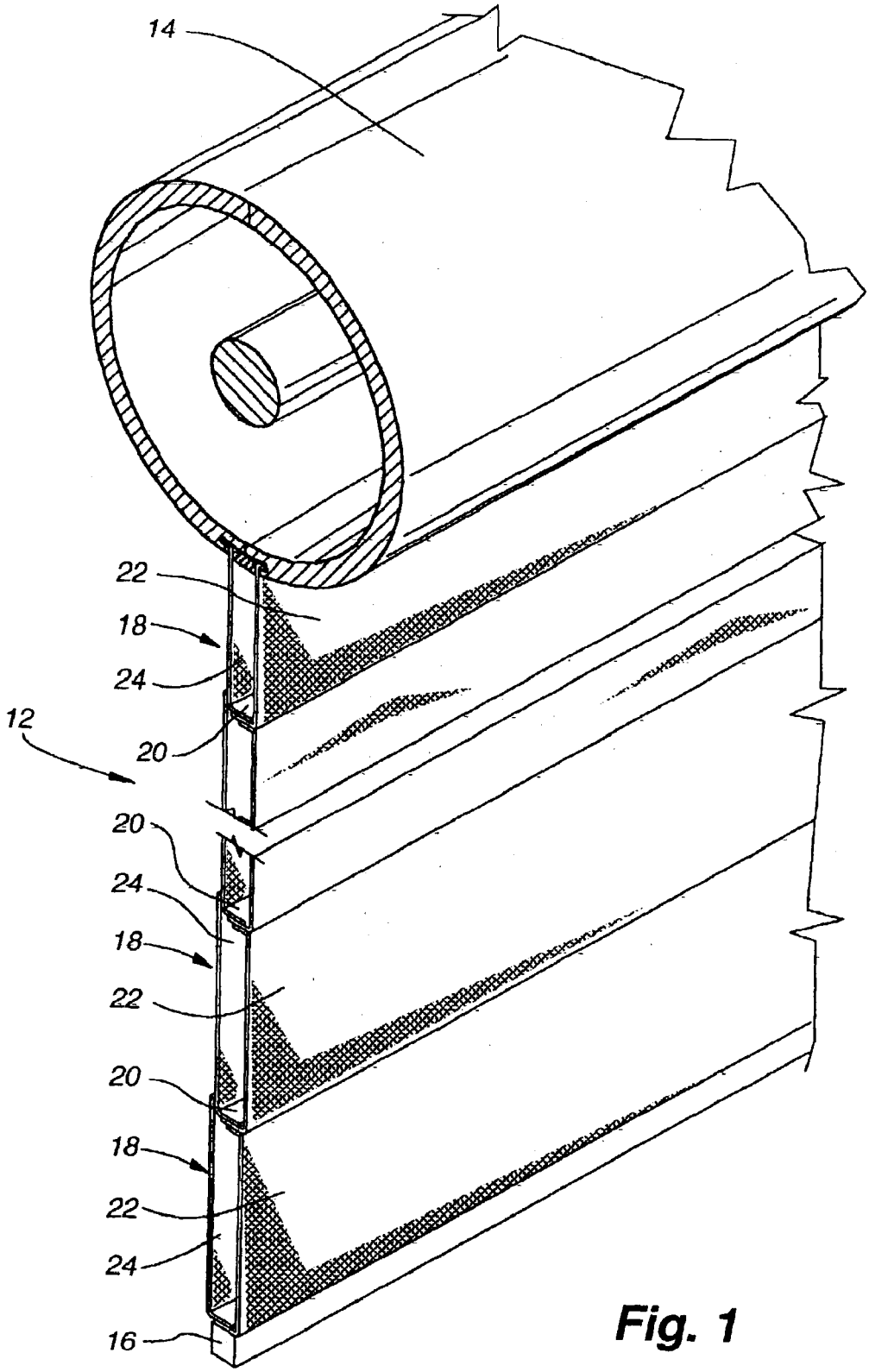
FIG. 1 is an isometric view of the cellular roller shade material installed with a head rail roller attached to its top end and a foot rail attached to its bottom end.
Figure 1A:
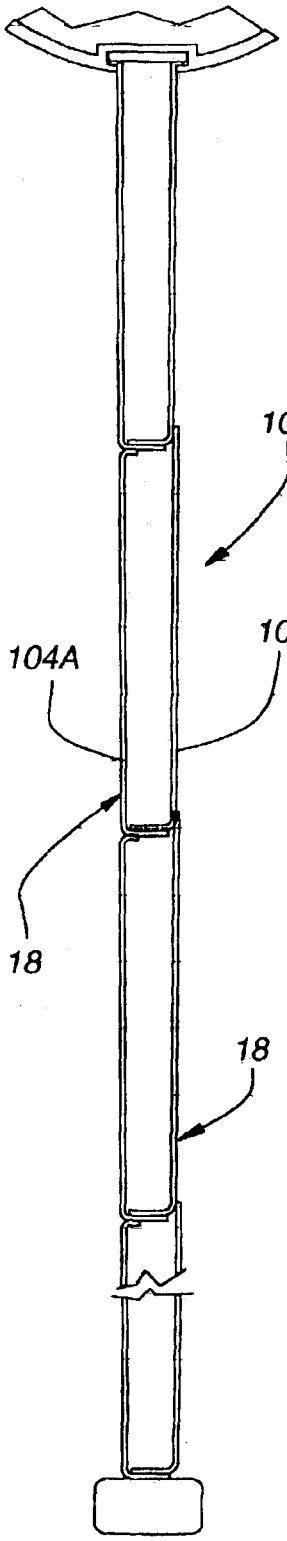
FIG. 1*a* is a fragmentary side elevation of the cellular roller shade material shown in FIG. 1.
Figure 1B:
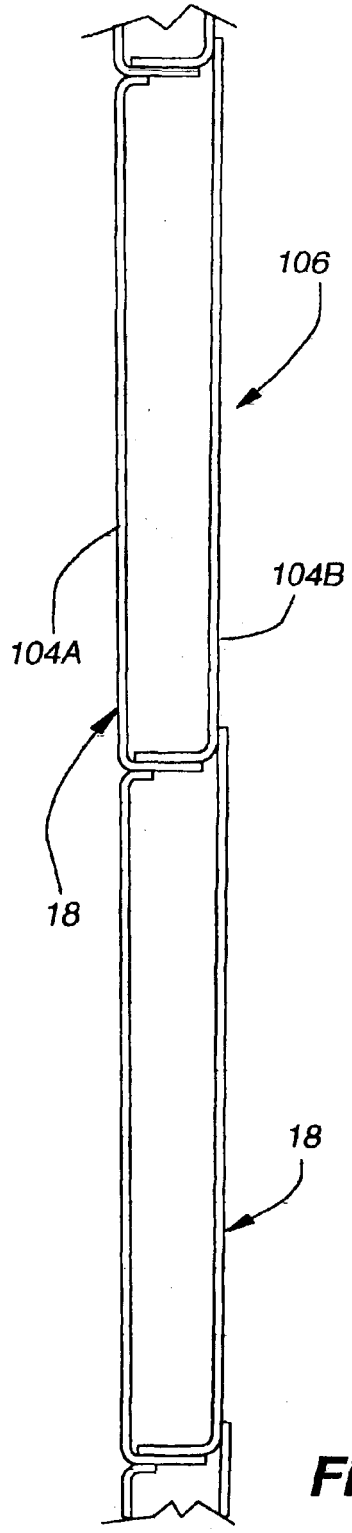
FIG. 1*b* is an enlarged fragmentary section of a portion of the cellular shade material shown in FIG. 1*a*.
Figure 1C:
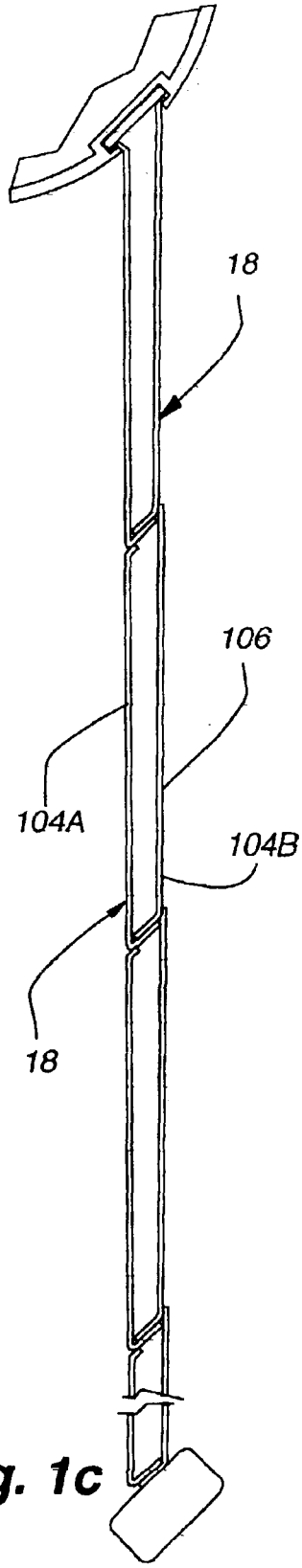
FIG. 1*c* is a fragmentary side elevation similar to FIG. 1*a* with the cells of the shade material partially closed.
Figure 1D:
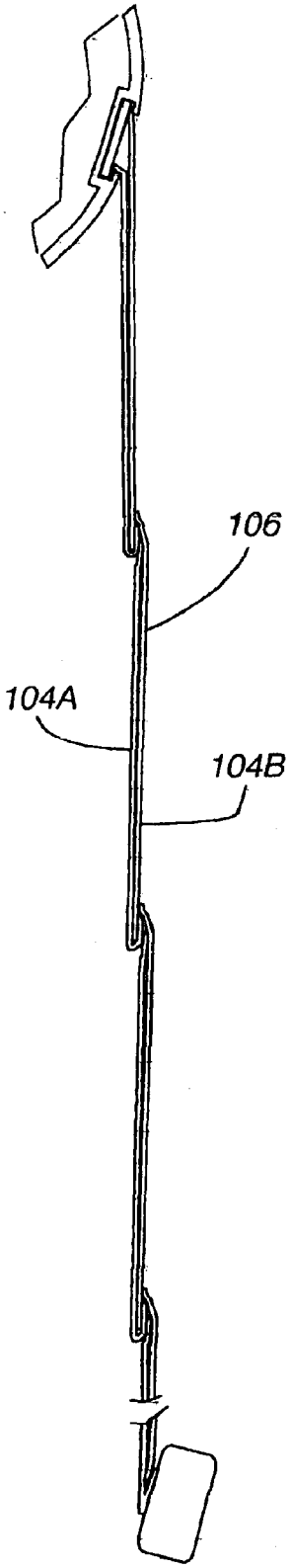
FIG. 1*d* is a fragmentary side elevation similar to FIGS. 1*a* and 1*c* wherein the cells of the shade material are fully closed.
Figure 1E:
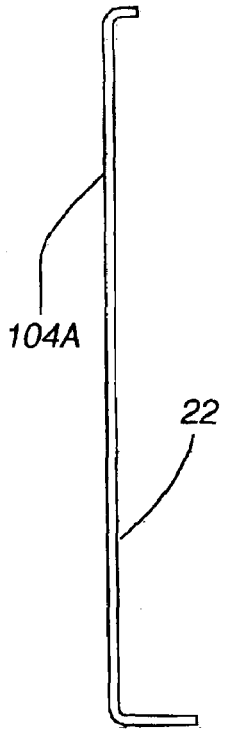
FIG. 1*e* is a side elevation of a front panel of a cell used in the shade material of FIG. 1.
Figure 2:
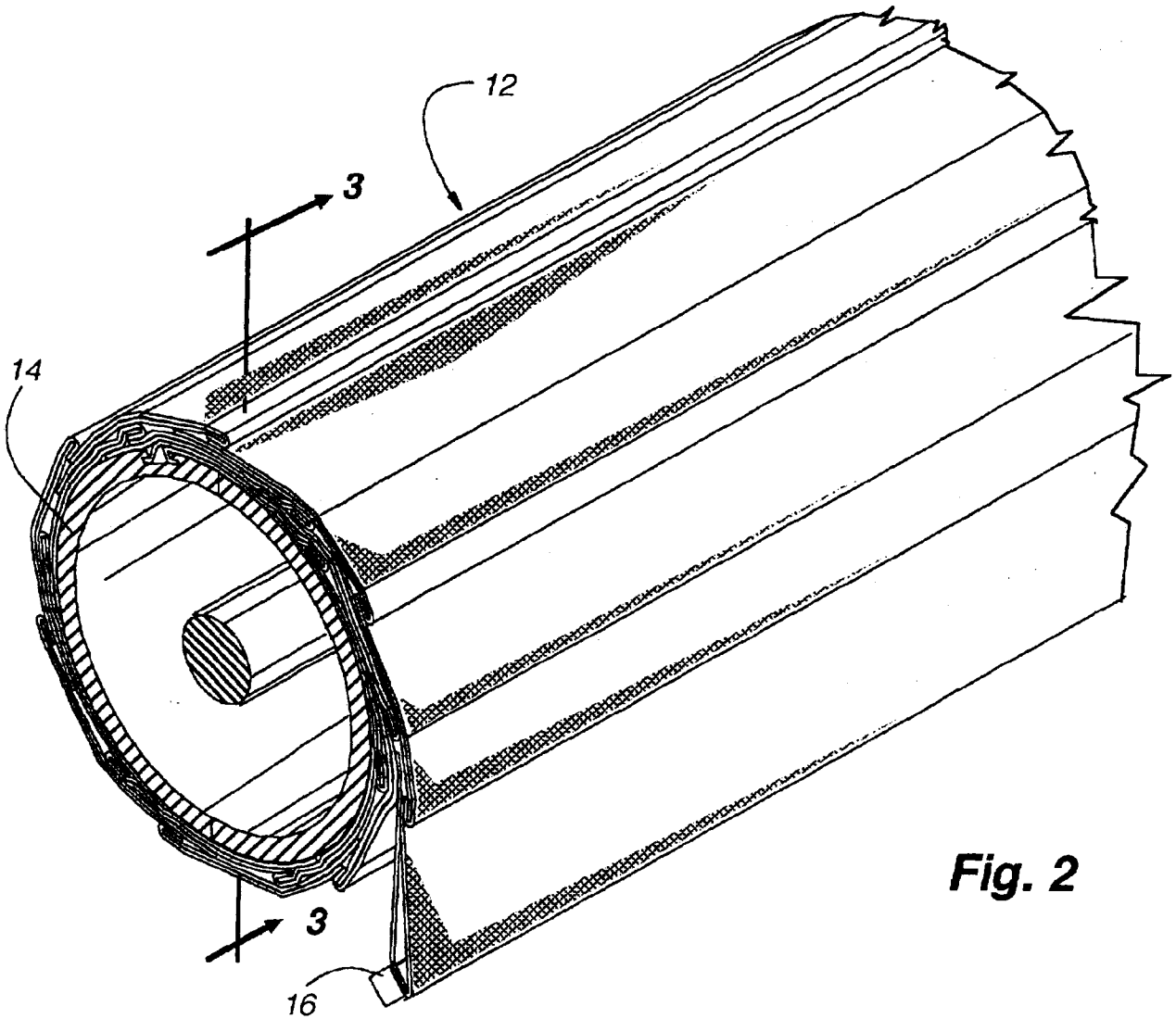
FIG. 2 is an isometric view of the cellular shade material rolled up onto a head rail roller.
Figure 3:
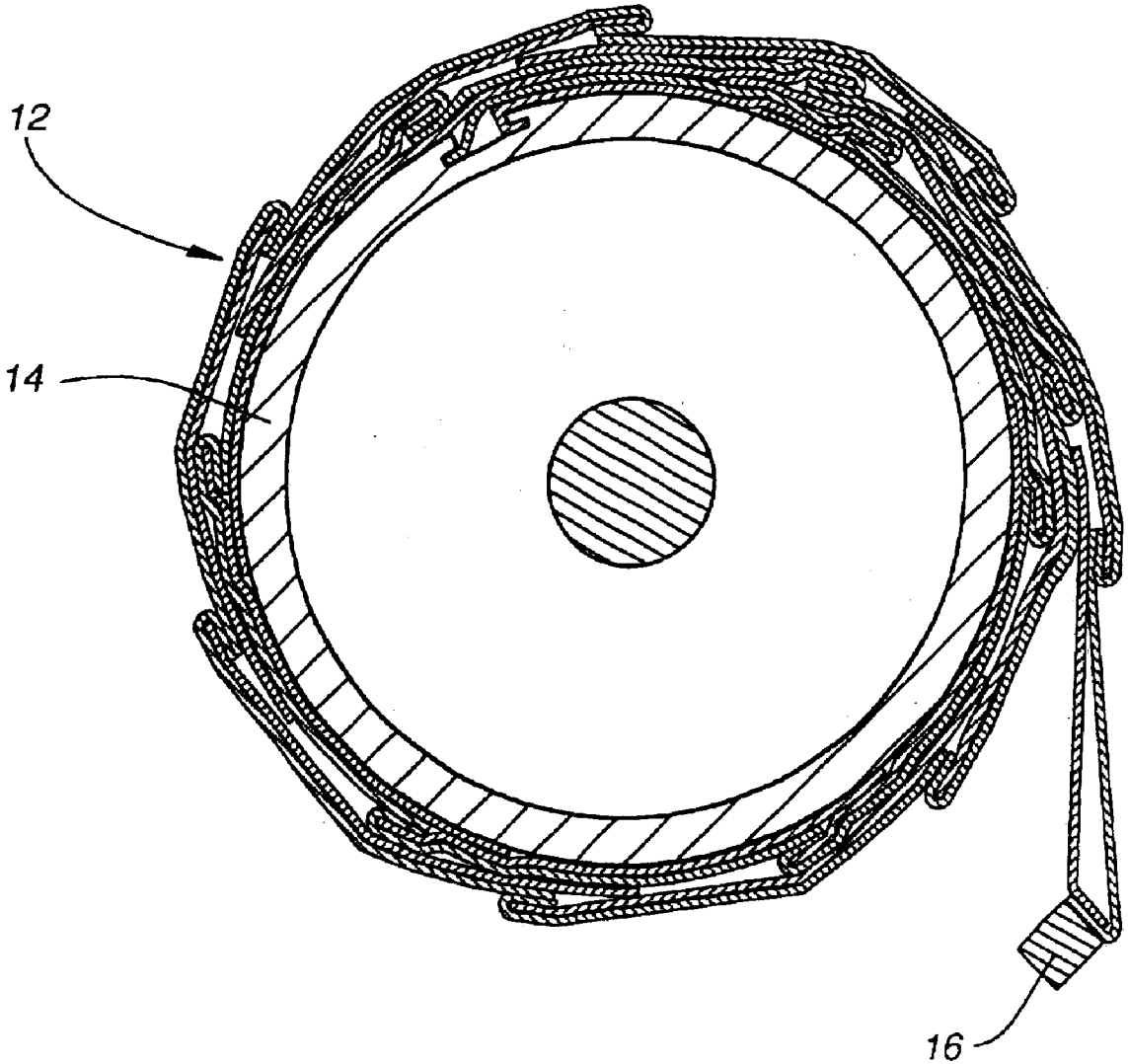
FIG. 3 is an end view of the cellular shade material wound around a head rail roller taken along line 3—3 of FIG. 2.

After fabrication, the cellular shade material 12 is then trimmed to the desired size and one end of the shade material is secured to a head rail roller 14, while the opposite end is secured to a weighted foot rail 16 as is shown in FIGS. 1–3. To complete the roller blind assembly, the head rail roller is secured into a head rail (not shown). The head rail typically includes a means for mounting the shade onto a vertical surface and a retraction mechanism that interfaces with the roller for lowering or raising the roller shade material.

Figure 1F:
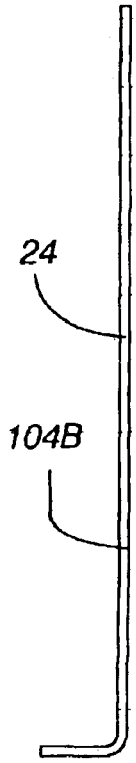
FIG. 1*f* is a side elevation of the rear panel of a cell used in the shade material of FIG. 1.

As illustrated in FIGS. 1–1*f*, the shade material 12 is primarily comprised of a plurality of horizontally extending cells 18 with rectangular cross sections that are joined to other cells 18 along a partial top side 19 and a bottom side 20. In one preferred embodiment of the roller shade material, the front side 22 of each cell comprises a decorative fabric as supplied by one of the two aforementioned rolls of fabric tape, and the back side 24 comprises another fabric (typically non-woven light diffusing fabric) supplied by the other roll of fabric tape.

The cellular shade material 12 provides several advantages when compared to single layer fabric shade material typically utilized in roller shade coverings. For instance, the dead air contained within the cells 18 provides a barrier to heat transfer, resulting in a roller shade covering with better insulating properties. Additionally, the light transmitted through a cellular shade can be better controlled to provide the desired effect. For example, the rear side 24 could comprise a fabric specified for the sole purpose of diffusing or blocking light, while the front side 22 could comprise a aesthetically pleasing fabric that if utilized in a single layer shade would not provide the desired light handling characteristics.

As illustrated in FIGS. 2–3, as the roller shade covering 12 is retracted and wound onto the roller 14, the cells 18 collapse wrapping compactly around the roller. Accordingly, the need for an enlarged head rail that is potentially aesthetically displeasing to contain the shade material 12 when retracted is obviated.

A Preferred Embodiment

Figure 4:
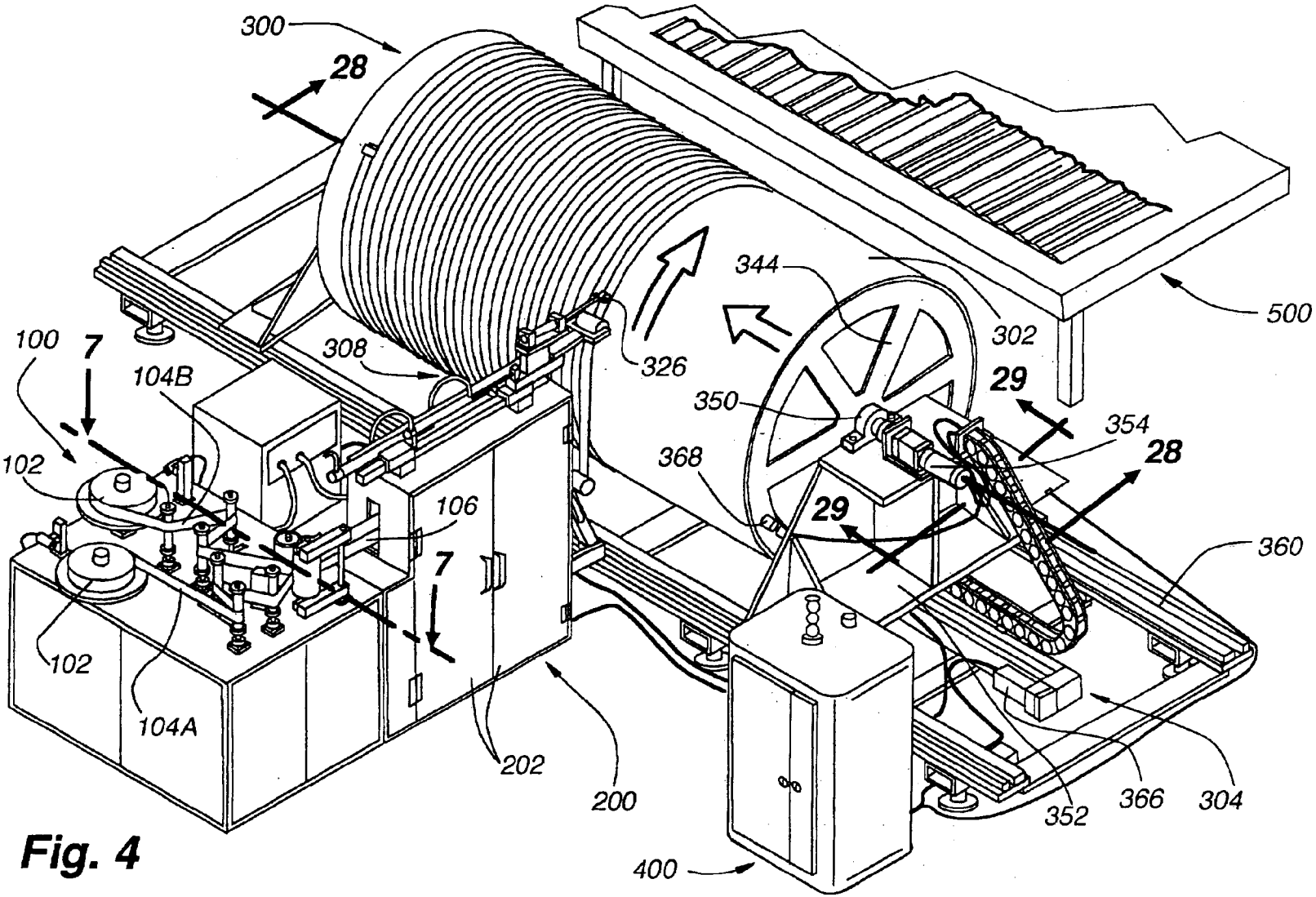
FIG. 4 is an isometric view of the cellular roller shade material fabrication apparatus.
Figure 5:
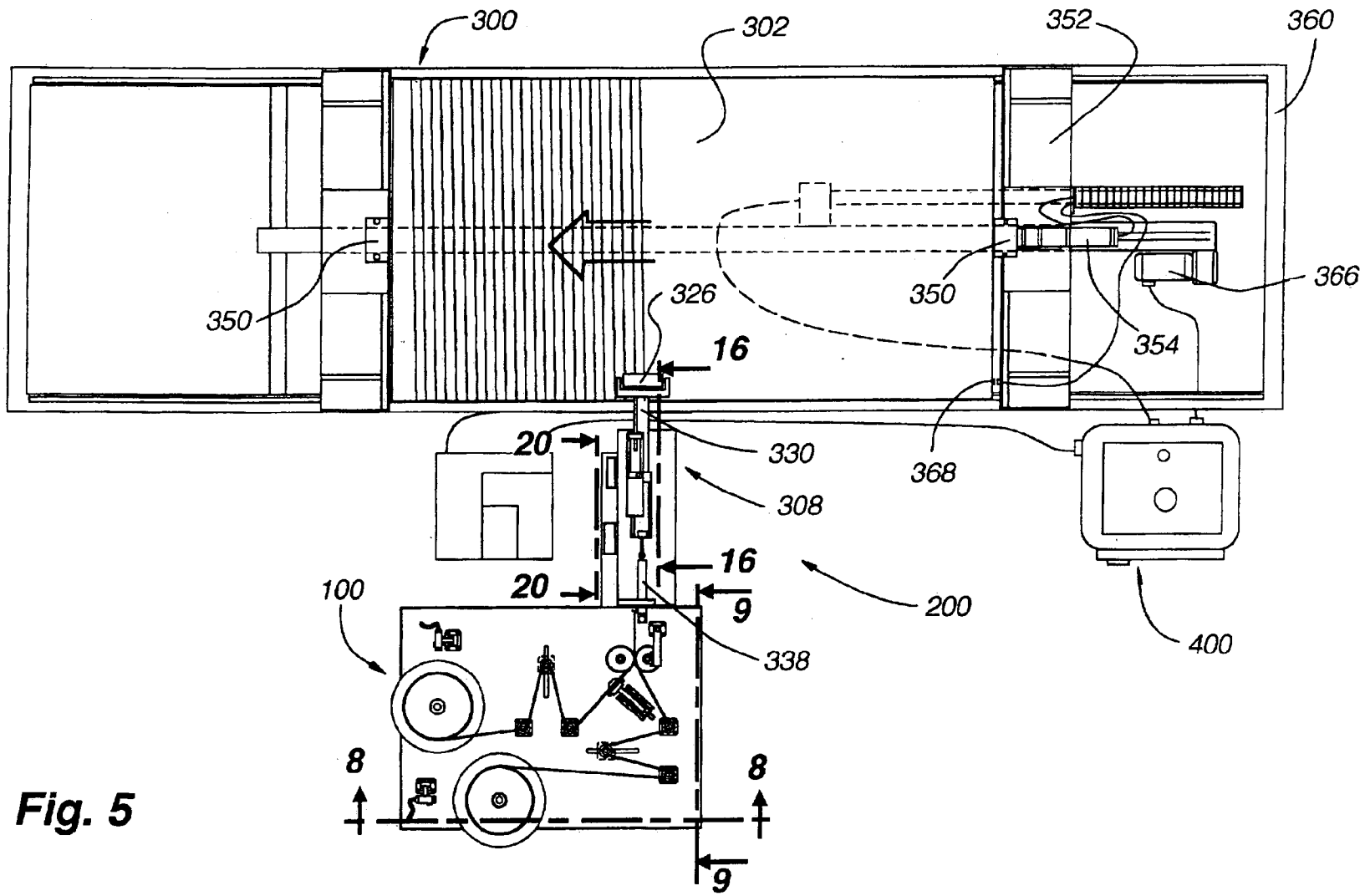
FIG. 5 is a top view of the fabrication apparatus.

A first embodiment of a fabrication apparatus for producing roller shade material 12 is illustrated in FIGS. 4–12 and 14–16. The fabrication apparatus includes a fabric tape supply section (supply section) 100, wherein fabric tapes 104 are unwound from rolls 102 and the tape is orientated for a subsequent folding operation. One or two rolls 102 of tape can be utilized. As shown in FIGS. 4 and 5, two fabric tapes 104 are unwound from separate rolls 102 and adhesively joined together for subsequent operations. One tape 104A forms primarily the front side 22 of the cells 18 of the resulting cellular shade material 12 and the other tape 104B forms primarily the back side 24 of the cells. The supply section 100 can also be configured with a single tape 104, wherein the tape forms both the front and back sides of the cells. The configuration and operation of the supply section is discussed in detail below.

Figure 6:
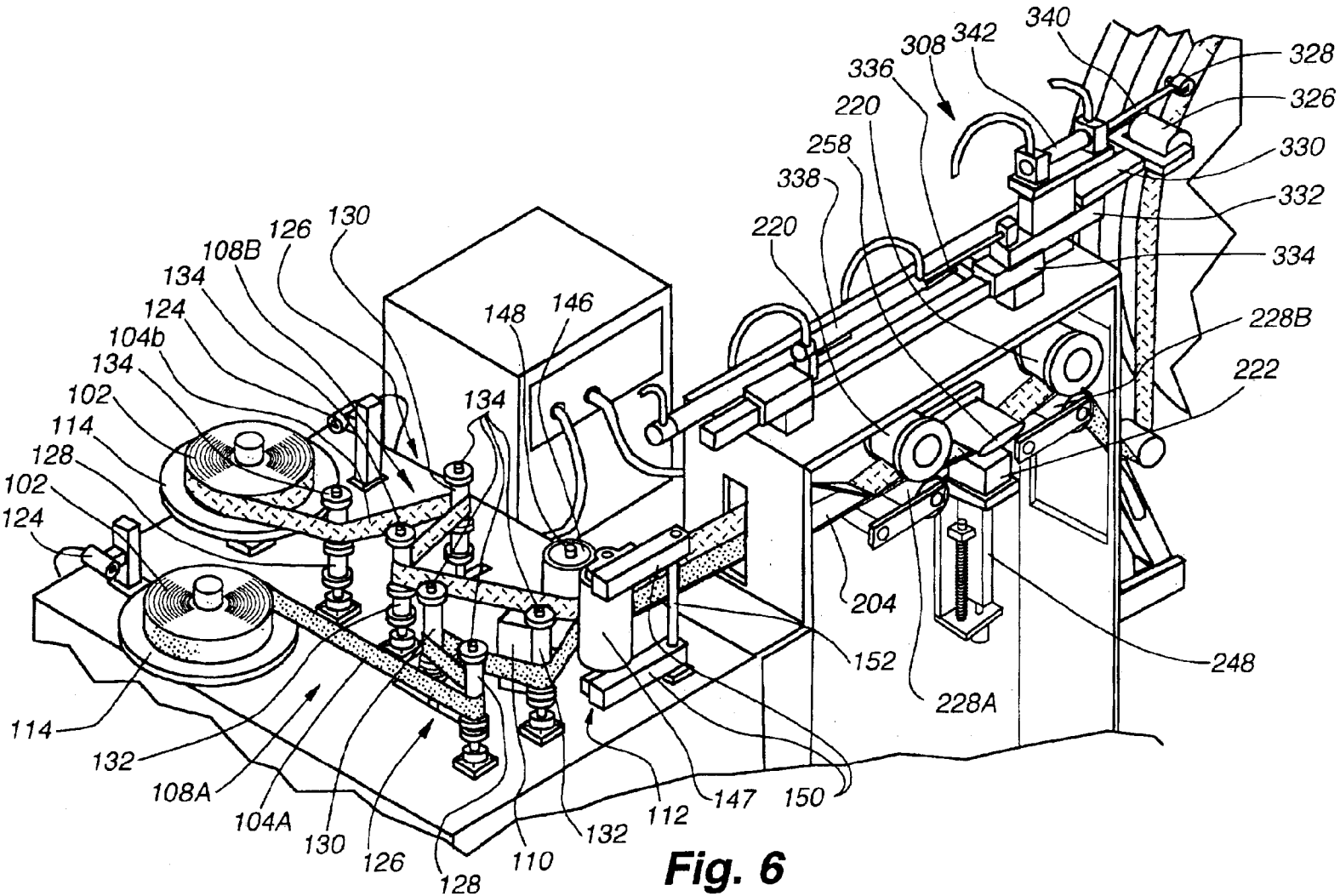
FIG. 6 is a partial isometric of the fabrication apparatus illustrating the supply and folding sections.

After exiting the supply section, the joined tape 106 is passed into the folding and adhesive application section (folding section) 200 of the fabrication apparatus. In FIGS. 4 and 5 the inner workings of the folding section are hidden behind a pair of access doors 202. FIG. 6 illustrates the inner working of the folding section 200, which will be described in detail below. Briefly, the joined tape 106 is folded along a longitudinal fold line that is offset from the longitudinal center axis of the joined tape. Next, parallel longitudinal lines of adhesive are applied to the overhanging portion of the folded tape 106.

The adhesive-laden folded tape 106 is then passed to the bonding section 300 to be longitudinally joined via the parallel adhesive lines to a section of the continuous folded tape that has been previously circumferentially wrapped around a rotating drum 302. As shown, the drum 302 also moves in its longitudinal direction at a specified rate of speed so that the amount of overlap between adjacent circumferentially wrapped folded tape sections is precisely controlled to create uniform cells 18 in the resulting cellular shade material 12. The configuration and operation of the bonding section 300 is described in detail below.

The various sections comprise a variety of servo motors and sensors that are controlled and utilized by a computerized controller 400. The controller helps ensure the tape is maintained at a constant tension as it passes through the fabrication apparatus and is deposited on the drum in a manner that results in a cellular shade material 12 comprised of uniformly-sized cells 18.

Once the folded tape 106 is circumferentially wrapped around substantially the entire surface of the drum 302, the fabrication apparatus is stopped. The cellular shade material 12 is then cut along the entire length of the drum 302 along a cut line that is substantially perpendicular to the longitudinal axis of the wrapped folded tape. It can be appreciated that the longitudinal axis of the tape will be canted slightly relative to the circumferential direction of the drum. Accordingly, the cut line will be slightly acute (approximately 1 degree in a preferred embodiment) relative to the longitudinal axis of the drum. The rectangular cellular shade material is then stacked on a layout table 500 pending subsequent operations to cut the material to size, affix a head rail roller 14 and a foot rail 26 to the material 12 and assemble it into a complete roller shade covering.

The Supply Section

Figures 11, 12, 13:
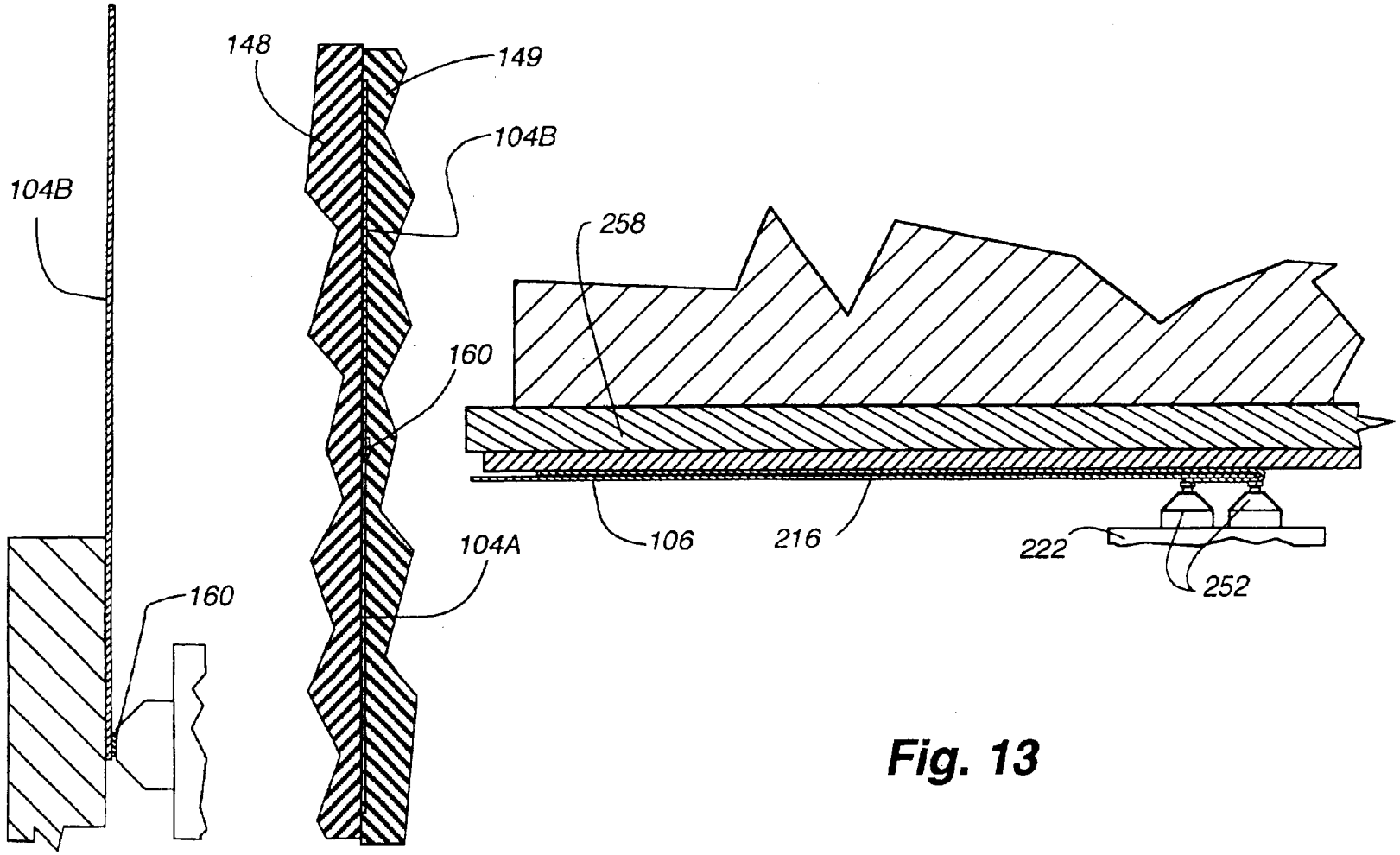
FIG. 11 is a cross sectional view of the adhesive applicator and the associated fabric tape as taken along line 11—11 of FIG. 7
FIG. 12 is a cross sectional view of the fabric tapes passing through the nip rollers as taken along line 12—12 of FIG. 7.
FIG. 13 is across sectional view of the second adhesive applicator as taken along line 13—13 of FIG. 16.
Figure 14:
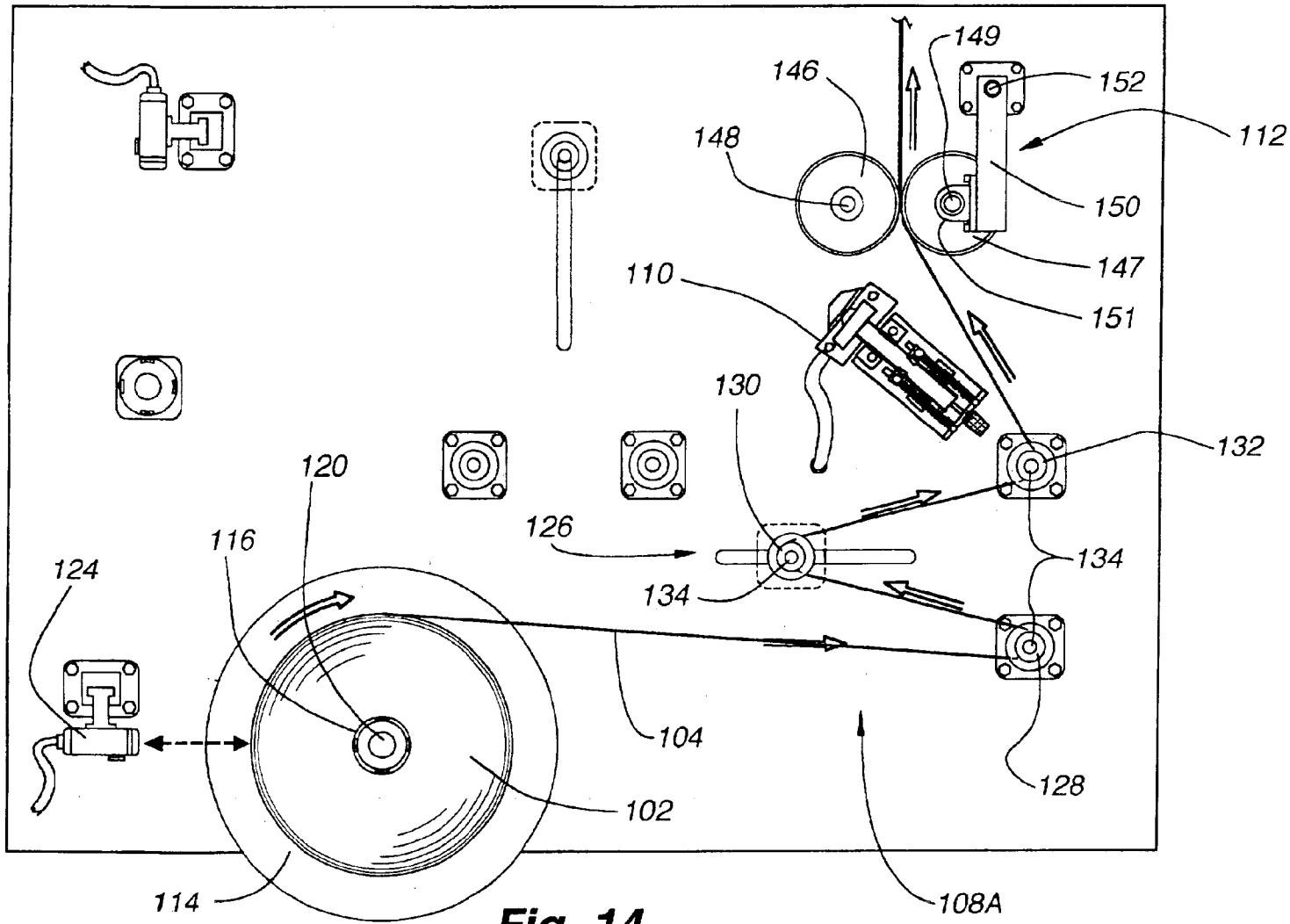
FIG. 14 is a top view of the supply section similar to FIG. 7, wherein only a single roll of "doublewide" fabric tape is utilized in place of two rolls of fabric tape.
Figure 15:
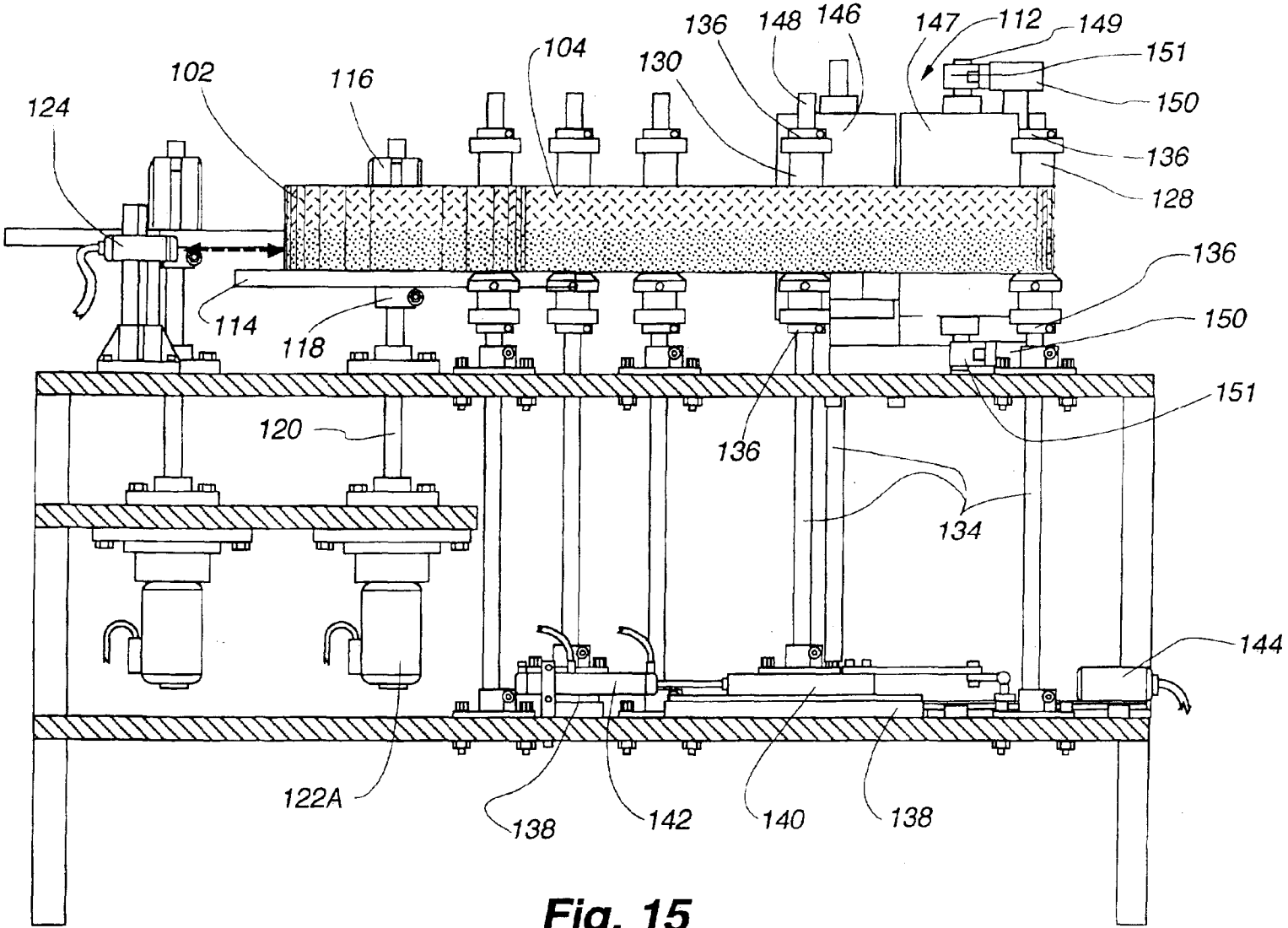
FIG. 15 is a side view of the supply section similar to FIG. 8 except set up for a single roll of "doublewide" fabric tape.

The fabric tape supply section 100 configured for two rolls of fabric tape 104 is illustrated in FIGS. 6–12, and a supply section configured for one roll of fabric tape is illustrated in FIGS. 14–15. The supply section typically includes (i) similar first and second fabric tape supply assemblies 108A and B; (ii) an adhesive applicator 110; and (iii) a nip roller assembly 112.

Referring to FIGS. 6–12, each fabric tape supply assembly 108 includes a turntable 114 with a center locking spindle 116 over which the hollow center of a roll 102 of fabric tape is fixedly secured. The turntable also comprises a collar 118 (best seen in FIG. 8) that is set to a vertically-orientated axle 120 that passes through the center of the turntable. By loosening the collar 118, the turntable can be moved vertically to adjust its positioning on the axle 120. At its bottom end, the axle 120 is coupled with an electric servo motor 122A or B, wherein the servo motor is adapted for turning the turntable 114. The servo motor is electrically coupled to the controller 400, which controls the operating speed of the motor. An ultrasonic sensor 124 is attached to the framework of the supply section 100 pointed towards the center of the turntable. The sensor 124 measures the distance between the sensor and the surface of the roll 102 of fabric tape contained on the turntable. This information is utilized by the controller to calculate the diameter and circumference of the roll for reasons that will become apparent in the controller section. The sensor 124 also determines through the controller when the roll 102 of tape is nearly exhausted so that the fabrication apparatus can be shut down to change the roll of fabric tape.

As the fabric tape 104 is unwound from the roll 102, it is pulled around a tape tensioning mechanism 126 comprising three spindles 128, 130 and 132. Each spindle is typically fabricated from a low friction material such as polyethylene, Derlin or Teflon. Each spindle has upper and lower flanges that both help to retain the tape 104 on the spindle and position the tape at a correct vertical height. Each spindle is rotatably secured to a steel shaft 134 by way of a pair of collars 136 that are attached to bearing assemblies (not shown). The bearing assemblies are configured to provide a measure of rotational friction, whereby the spindle does not spin freely about its associated steel shaft (for example, by packing the bearings with a high viscosity grease). The fabrication apparatus has been found to operate better when the spindles do not turn in unison with the fabric tapes passing around them. Ideally, the rotational speed of the surface of the spindles as the tape passes over it is 10% slower than the linear speed of the tape. In other words, the tape both slips on the surface of the spindles, as well as, causing the spindles to rotate. The collars 136 permit the spindles to be adjusted up and down to vertically position the tape passing around it.

Figure 7:
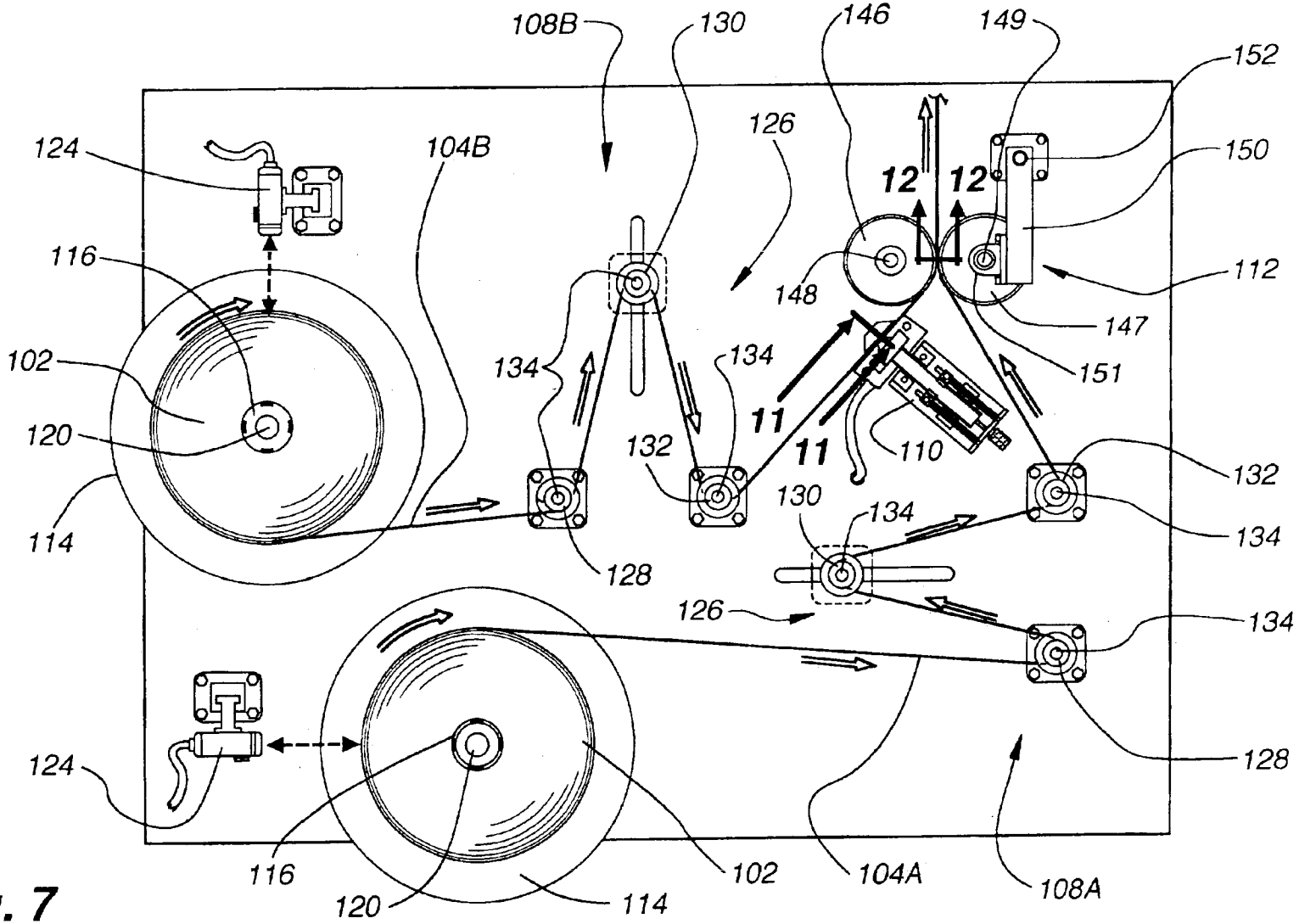
FIG. 7 is a top view of the supply section taken along line 7—7 of FIG. 4.
Figure 8:
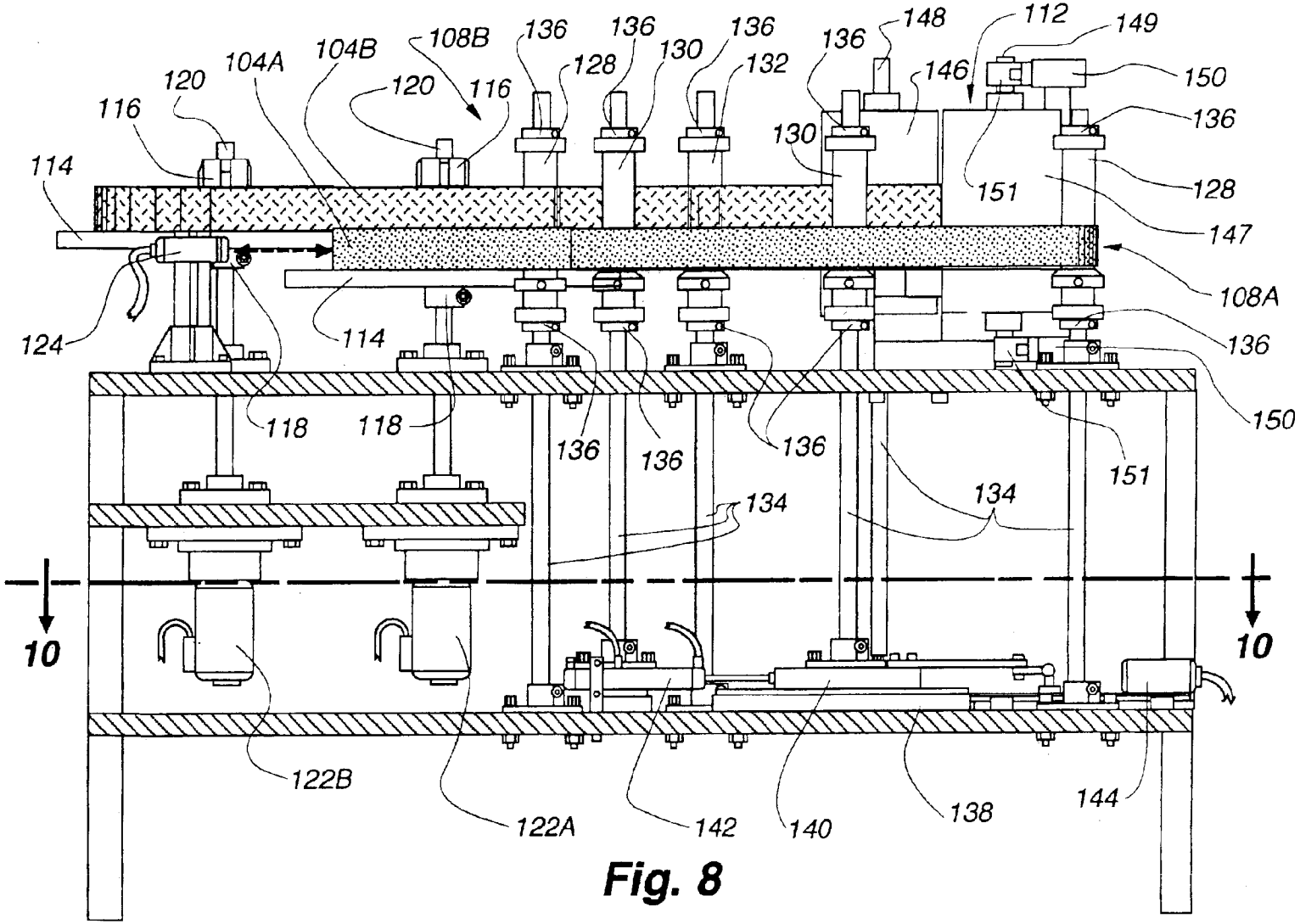
FIG. 8 is a side view of the supply section taken along line 8—8 of FIG. 5.

The steel shafts 134 associated with the first and third spindles 128 and 132 of each of the fabric tape supply assemblies 108A and 108B is immovably fixed to the framework of the supply section 100 and are either horizontal or vertically aligned with each other (as viewed in FIG. 7). The steel shaft associated with the second spindle 130 is coupled with a linear slide table 138 permitting a measure of movement in a direction substantially perpendicular to the direction of alignment of the associated first and third spindles 128 and 132. The second spindle is also typically centered between in the first and third spindles in the alignment direction.

Figure 10:
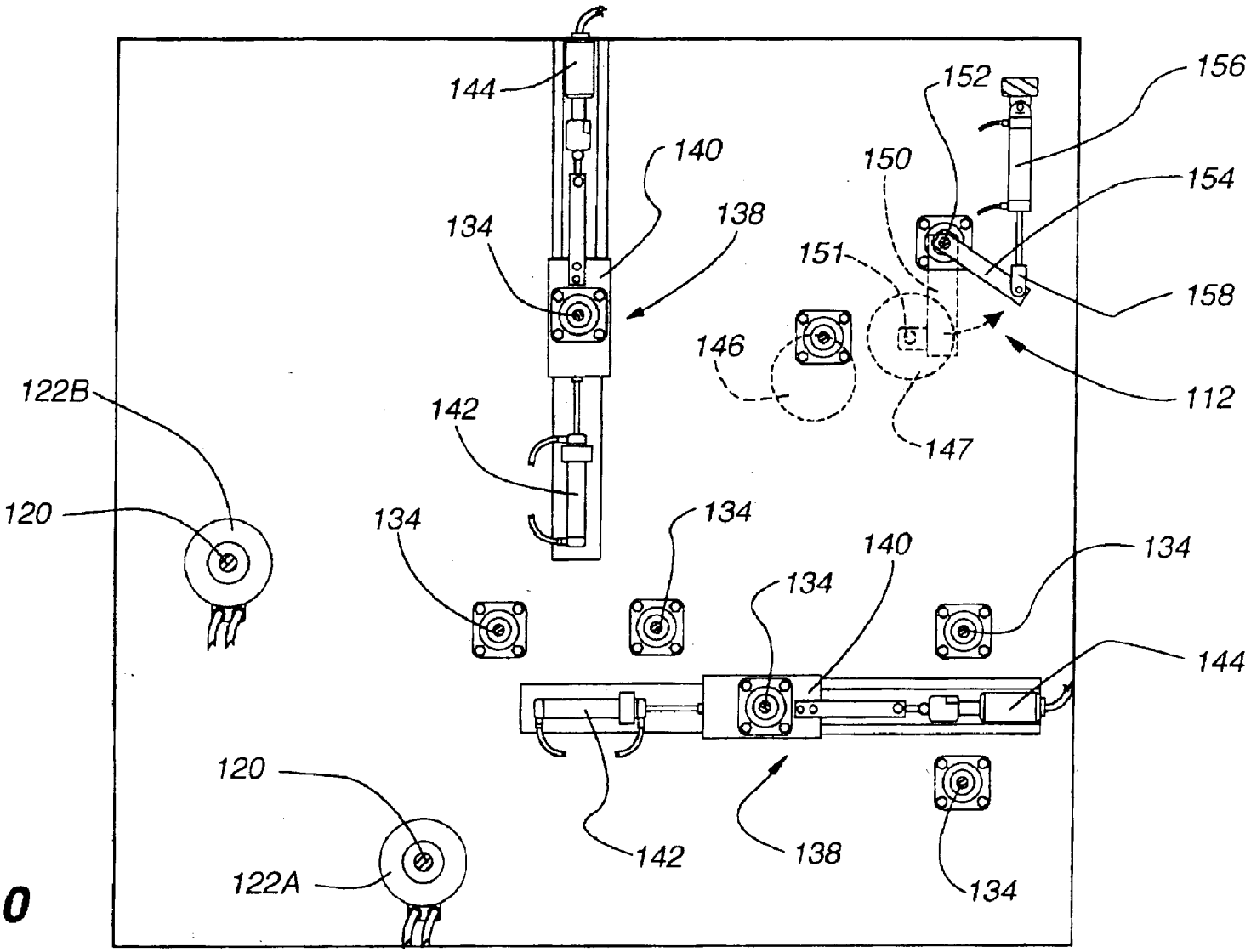
FIG. 10 is a top view of a portion of the supply section taken along line 10—10 of FIG. 8.

Referring primarily to FIG. 10, the moveable portion 140 of the linear slide table 138 is connected to the shaft of a pneumatic cylinder 142 at one end and a linear position transducer 144 at the opposite end. The pneumatic cylinder, which is coupled with a pressurized air source through a regulator (neither shown), biases the second spindle 130 away from the first and third spindles 128 and 132, thereby tensioning the tape 104 passing around it. The linear position transducer 144 measures the position of the second spindle in the slide table 138 and sends this information to the controller 400. The controller uses this information to adjust the speed of the turntable servo motor 122A or B as necessary to maintain the spindle 130 near the middle of the table 138 as is discussed in greater detail in the controller section below.

Figure 9:
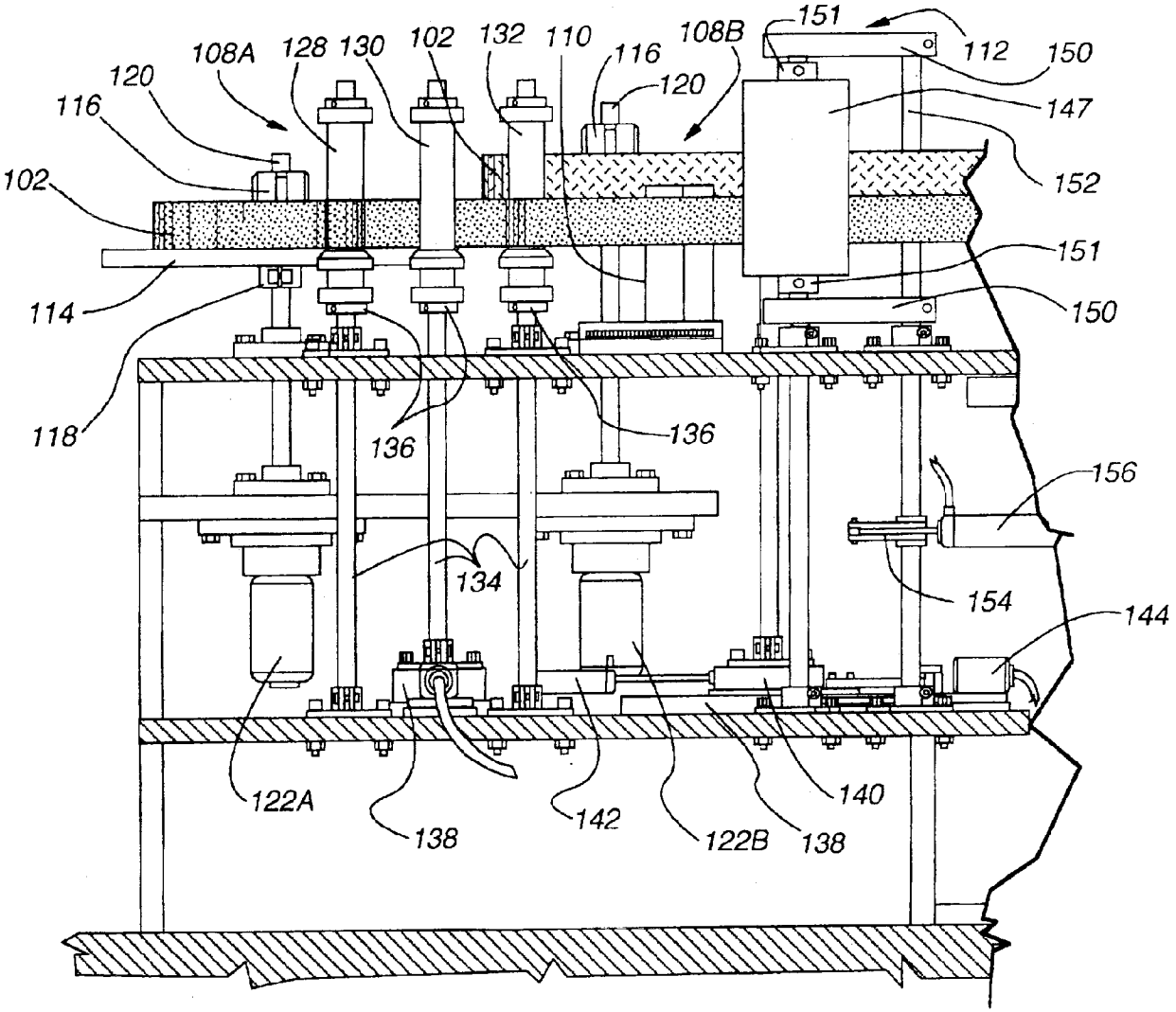
FIG. 9 is a side view of the supply section taken along line 9—9 of FIG. 5.

Referring to FIGS. 6 and 7, from the third spindle 134, the tape 104 is pulled through a pair of nip rollers 146 and 147 of the nip roller assembly 112. The nip rollers comprise two vertically orientated elongated cylinders that are covered in a resilient material such as rubber or silicone. Each nip roller is mounted to a steel shaft 148 or 149. The steel shaft 148 of the left roller is rotatably mounted to the framework of the supply section through a pair of bearing assemblies. The steel shaft 149 of the right nip roller is rotatably mounted proximate its ends to a pair of arms 150 by way of two bearing assemblies 151 (as best seen in FIG. 9). The other end of the arms are connected to a shaft 152 which is pivotally fixed to the framework by one or more bearing assemblies. As best seen in FIGS. 9 and 10, a pivot arm 154 is affixed to and extends from the shaft 152. The other end of the pivot arm is pivotally attached to the shaft of a pneumatic cylinder 156 by way of a clevis 158. The opposite end of the pneumatic cylinder 156 is pivotally attached to the framework. Operationally, the surface of the second nip roller 147 can be moved against the surface of the first nip roller 146 to apply pressure therebetween. Alternatively, the second roller may be moved away from the first to facilitate the threading of the fabric tapes 104A and B therebetween during fabrication apparatus setup.

In one variation of the preferred embodiment of the fabrication apparatus, both fabric tape supply assemblies 108 are threaded with fabric tape 104A and B. Typically, the tape from one assembly forms the back side of the cells of the resulting roller shade material and the tape from the other assembly forms the front side of the cells. It can be appreciated that a more expensive and more aesthetically pleasing tape may often be used for the front side and a less expensive material such as a light diffusing non-woven mat may be used for the back side.

As mentioned above, the two tapes 104A and B are adhesively joined to form a single joined tape 106 that is almost twice as wide as the constituent tapes 104A and B. An adhesive applicator 110 is provided between the third spindle 132 of the fabric tape supply assembly associated with the fabric tape 104B that forms the back side of the cells and the nip roller assembly 112 in the path of the fabric tape 104B. As shown in FIGS. 7 and 11, a longitudinal bead 160 of thermoplastic (or hotmelt) adhesive is applied to the rightward facing side of the tape 104B proximate its bottom edge as the tape passes by the adhesive applicator 110.

Referring to FIG. 12, the tapes 104A and 104B from both tape supply assemblies 108 converge at the nip rollers 148 and 149 with the leftwardly facing side of one tape 104A proximate its top edge overlapping the rightwardly facing side of the other tape 104B at the adhesive bead 160. Typical overlap is about 0.125" and is set by adjusting the vertical heights of the turntable 114 and spindles 128-32 of each tape supply assembly 108 so that the tape 104B that forms the rear side 24 of the cells 18 is disposed vertically above the tape 104A that forms the front sides 22 except for the overlapping portions. As the tapes 104A and B are pulled through the nip rollers, the resilient roller coverings are deformed around the overlapping portion of the tapes, thereby applying pressure to the bondline. The adhesive bead 160 is pressed against and into both tapes joining them together as the adhesive cools and re-solidifies. The resulting joined tape 106, which has a width that is slightly less than twice the width of either of its constituent tapes 104A and B, is pulled from the rollers into the folding section 200.

Figure 1G:
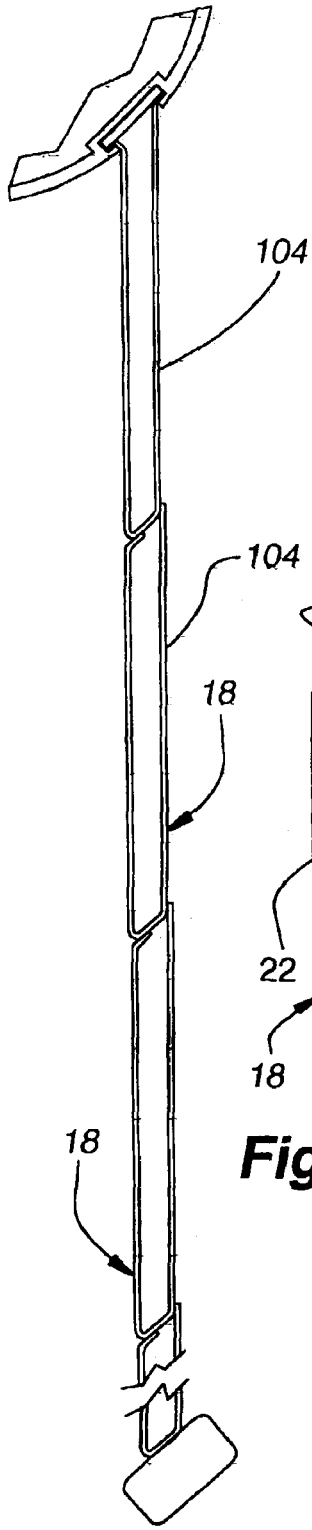
FIG. 1*g* is a fragmentary side elevation of a second embodiment of the cellular material of the present invention with the cells in a partially closed condition.
Figure 1H:
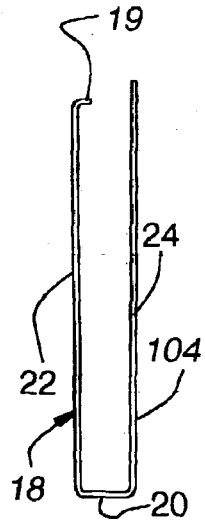
FIG. 1*h* is a side elevation of a panel of material used to form the cell of the embodiment of FIG. 1*g*.

Referring to FIGS. 14 and 15, the supply section 100 can also be set up with a single roll of "doublewide" fabric tape 104 for fabricating roller shade cellular material 12 in which the front and back sides 22 and 24 of the cells 18 are comprised of the same material as illustrated in FIGS. 1*g* and 1*h*. As shown in FIG. 14, the single roll of tape 104 is secured to a turntable 114 of one of the tape supply assemblies 108 and the tape is threaded around the associated first, second and third spindles 128-32 and passed through the nip roller assembly 112. The other tape supply assembly and the adhesive applicator 110 are not utilized with this configuration.

The Folding Section

Figure 16:
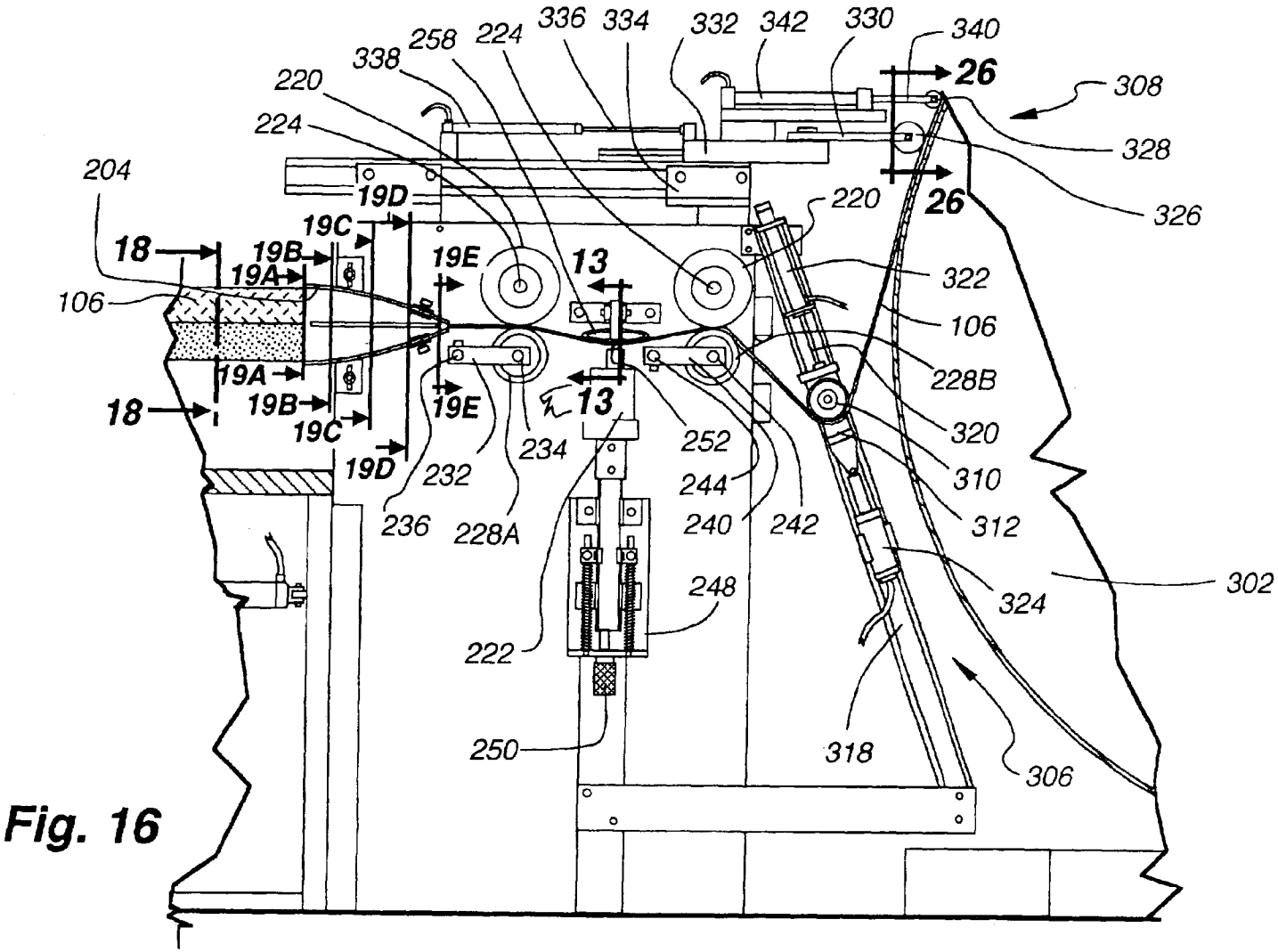
FIG. 16 is a side view of the folding section of the fabrication apparatus as taken along line 16—16 of FIG. 5.
Figure 17:
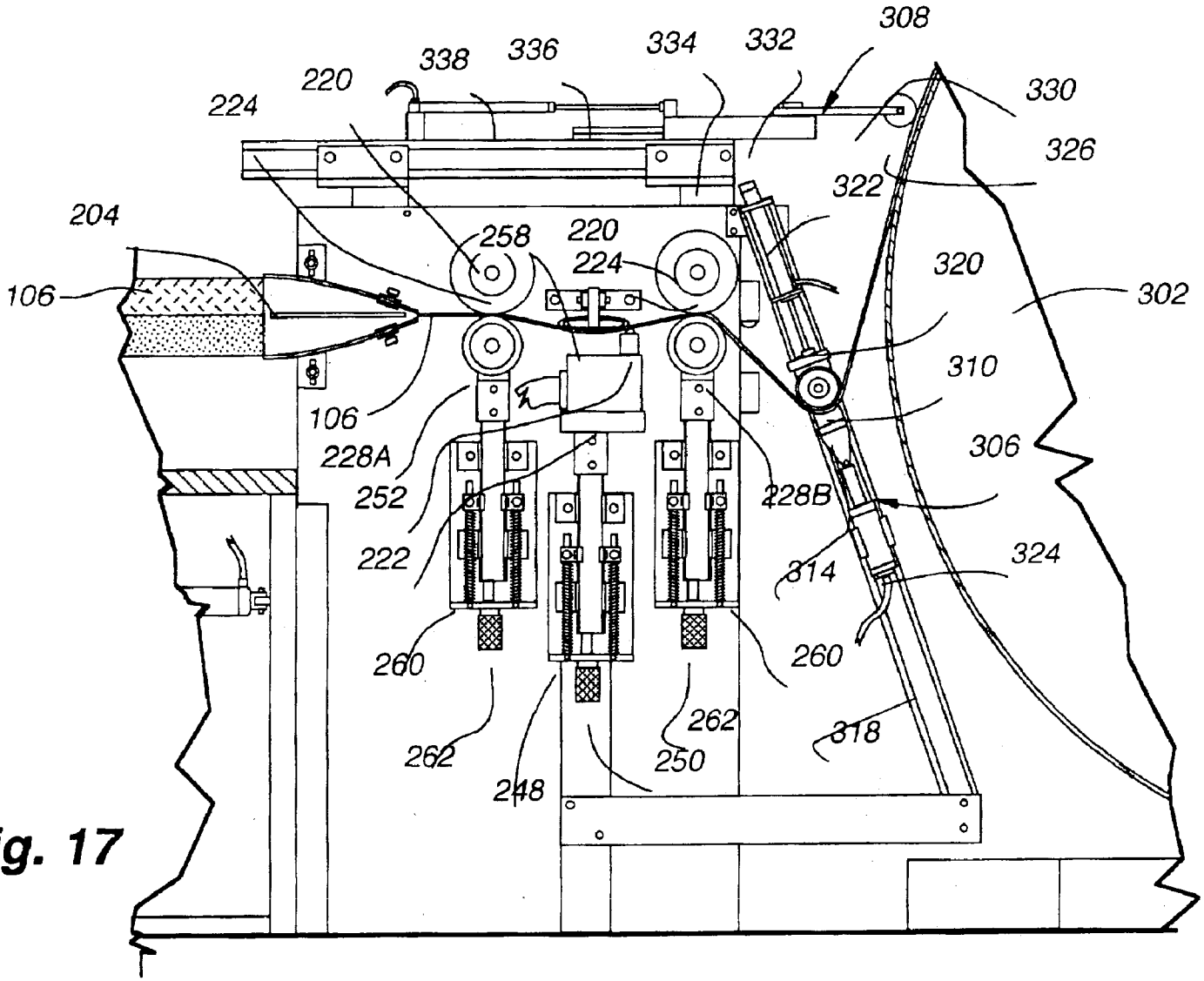
FIG. 17 is a side view of one variation of the folding section taken along line 16—16 of FIG. 5.
Figure 18:
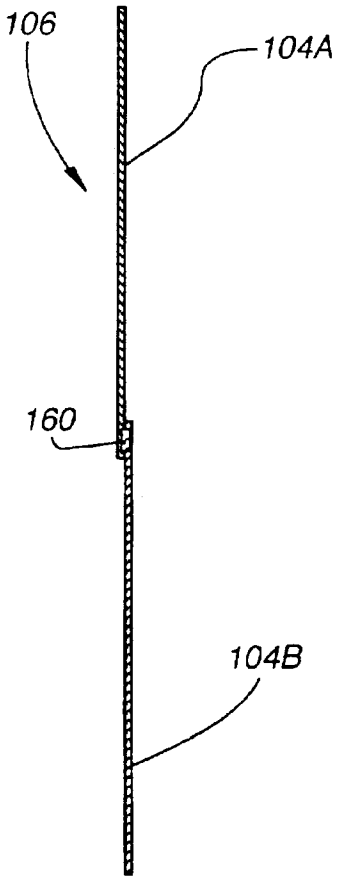
FIG. 18 is a cross sectional view of the joined fabric tape as taken along line 18—18 of FIG. 16.

The folding section, wherein the joined tape 106 or "doublewide" tape 104 is folded longitudinally and twin adhesive lines are applied to one side of the folded tape, is illustrated in FIGS. 6 and 16–21. Referring primarily to FIG. 16, after exiting the nip rollers 148 and 149, the joined tape 106 (as shown in FIG. 18) is pulled through a folding horn 204. As the tape 106 is pulled through the horn 204, it is folded along a longitudinal line parallel to but offset a short distance from the longitudinal center axis of the joined tape. Additionally, the orientation of the tape is changed from vertical to horizontal.

Figure 19B:
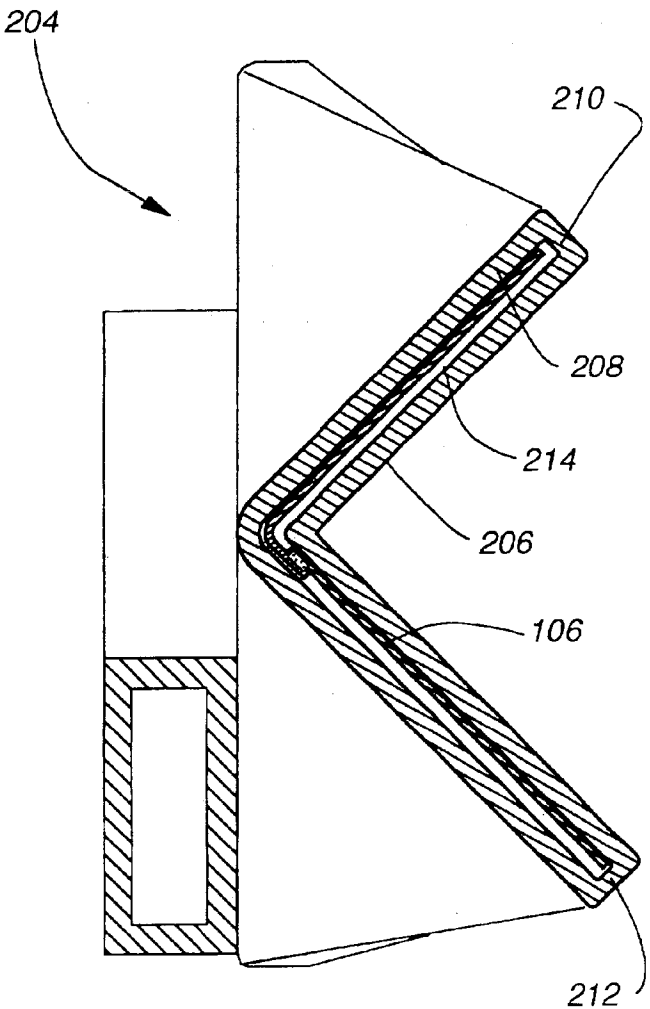
FIGS. 19A–E are cross sectional views of the folding horn taken along lines A–E of FIG. 16.
Figure 19A:
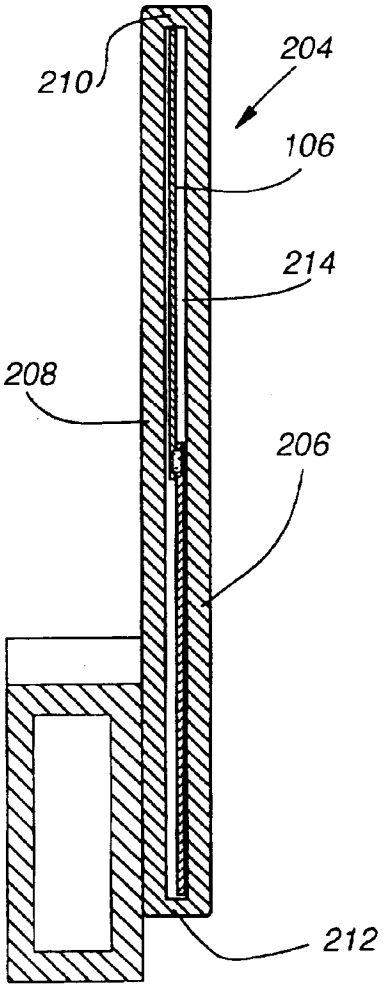
Figure 19D:
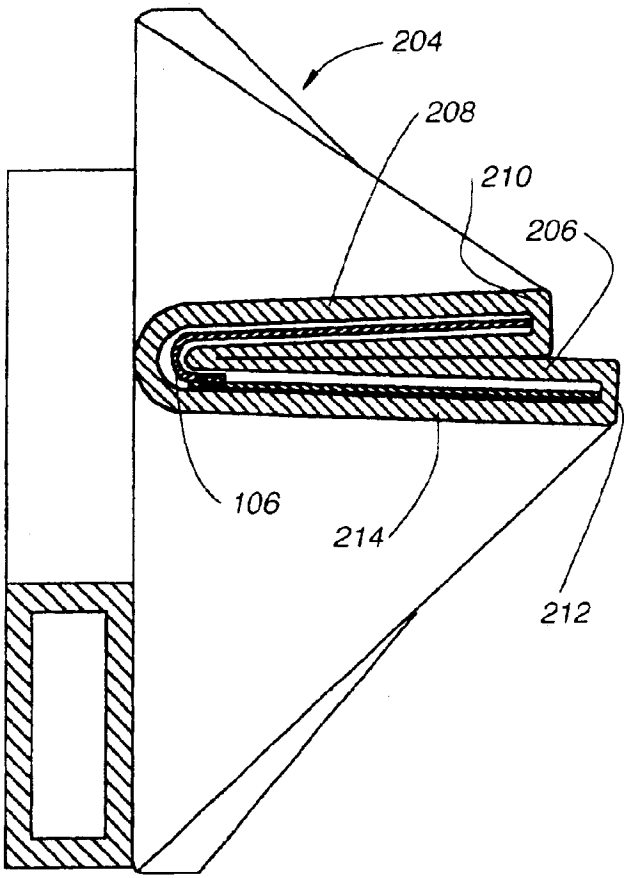
Figure 19C:
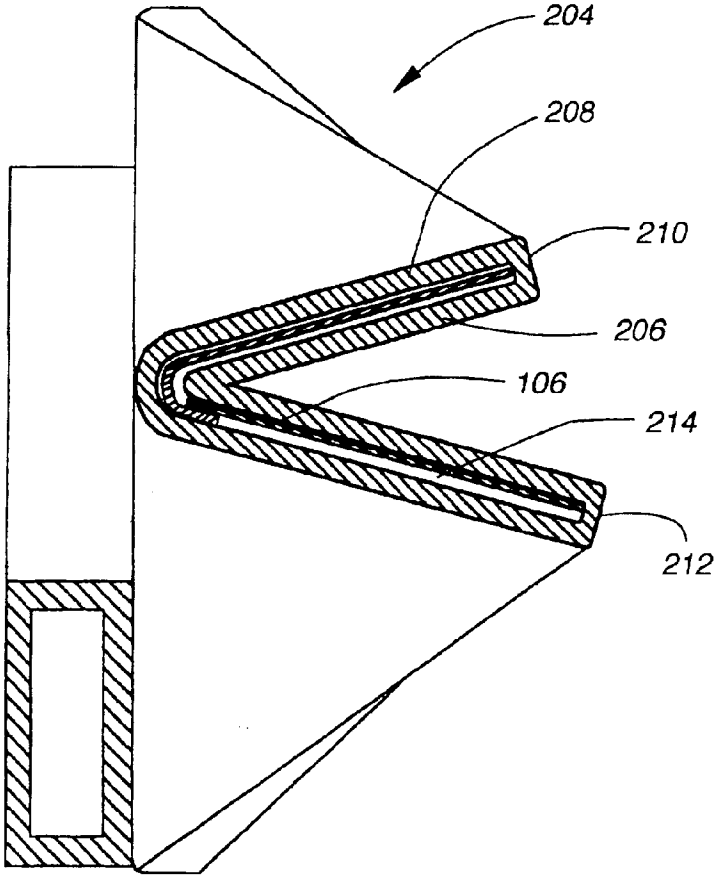
Figure 19E:
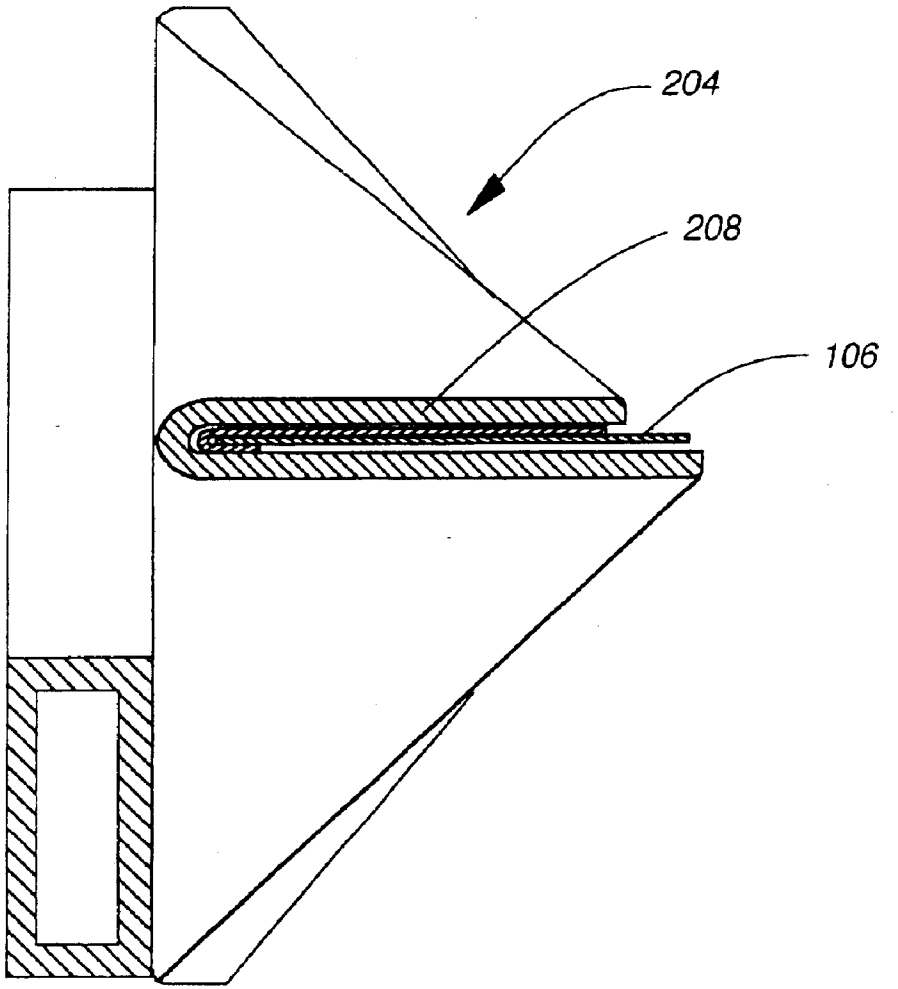
Figure 22:
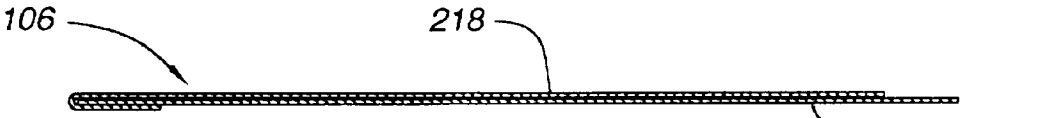
FIG. 22 is a cross sectional view of the folded fabric tape as viewed along line 22—22 of FIG. 16.

As best illustrated in FIGS. 19A–E, the horn 204 comprises a pair of substantially parallel plates 206 and 208 joined at their ends by top and bottom sides 210 and 212 respectively that form a slot 214 through which the joined tape 106 passes. As shown in FIG. 19A, a cross section of the horn 204 at its left end, the slot 214 is initially straight and substantially vertically orientated. The width of the slot is at least slightly greater than the thickness of the adhesively-joined overlapping section of the joined tape 106. The vertical height of the slot is slightly longer than the width of the combined tape such that the proper positioning of the tape is ensured when it enters the horn. FIGS. 19B–E illustrate the cross sections of the horn as it extends from the left to the right. As can be seen, the plates 206 and 208 forming the left and right sides of the slot begin to bend over onto themselves about a fold line that is located above the central longitudinal axis of the tape. Finally, near the right end of the horn the inside plate 208 of the slot terminates and the sides of the remaining outside plate 206 close in upon themselves to create a folded fabric tape 106 as shown in FIG. 19E. It is of importance to note that the bottom side 216 of the folded tape overhangs the upper side 218 by an amount substantially equal to the distance the longitudinal fold line is offset from the central longitudinal axis of the tape. A cross sectional view of the folded tape 106 is illustrated in FIG. 22.

Figure 20:
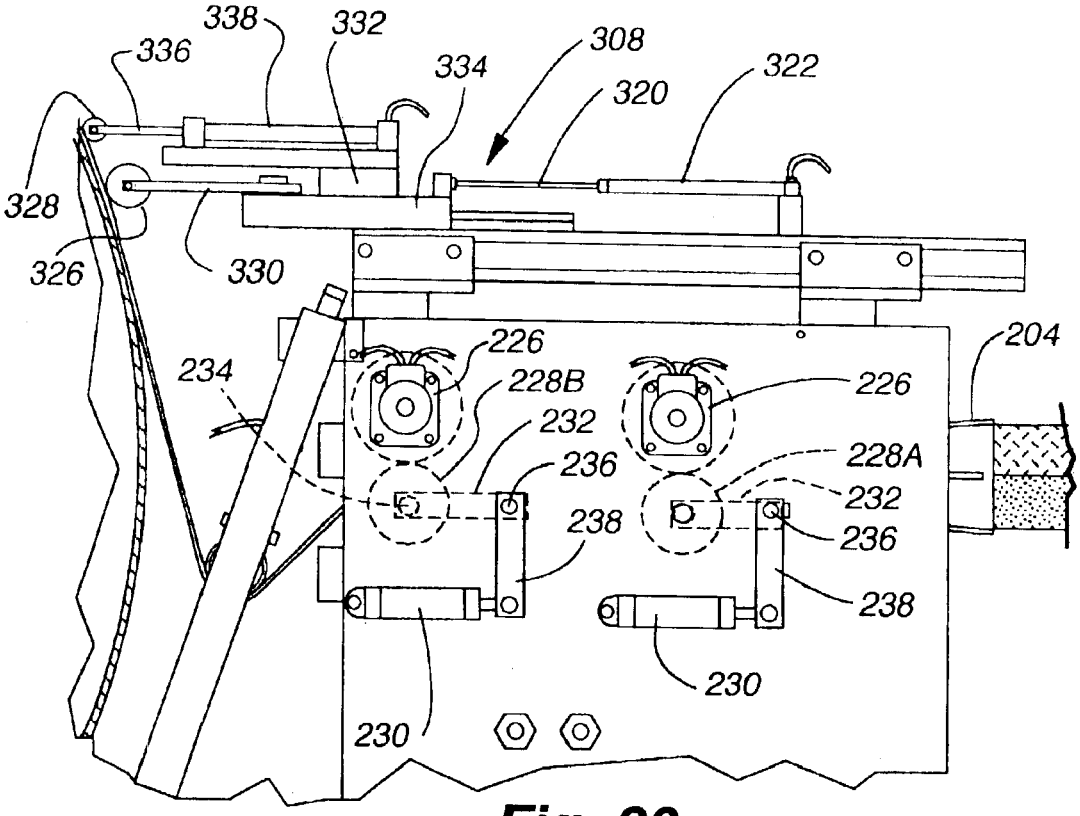
FIG. 20 is a backside view of the folding section as taken along lines 20—20 of FIG. 5.

From the right edge of the horn, the folded tape 106 is pulled to the right by a pair of drive wheels 220 that flank a second adhesive applicator 222. The drive wheels 220 are cylindrically shaped and have a recessed portion on their surface (as shown in FIG. 6), wherein the width of the recessed portion is slightly greater than the folded width of the tape 106. Accordingly, the drive wheels help ensure proper front to rear alignment of the tape as it passes over the adhesive applicator 222. The drive wheels are each attached to a drive shaft 224 through a center passage. The drive shafts 224 are each coupled with a servo motor (as shown in FIG. 20). Like the servo motors in the supply section 100, these servo motors 226 are coupled with the controller 400, which controls their operational speed.

Referring back to FIG. 16, an idler wheel 228 is disposed vertically beneath each of the two drive wheels 220. Each idler wheel is cylindrically shaped (as shown in FIG. 6) having a longitudinal length similar to the length of the recessed portion of the associated drive wheel, wherein each idler wheel nests in the recessed portion of the associated drive wheel helping to ensure the proper front to rear positioning of the folded tape 106 as it passes between each drive wheel and the associated idler wheel.

Figure 21:
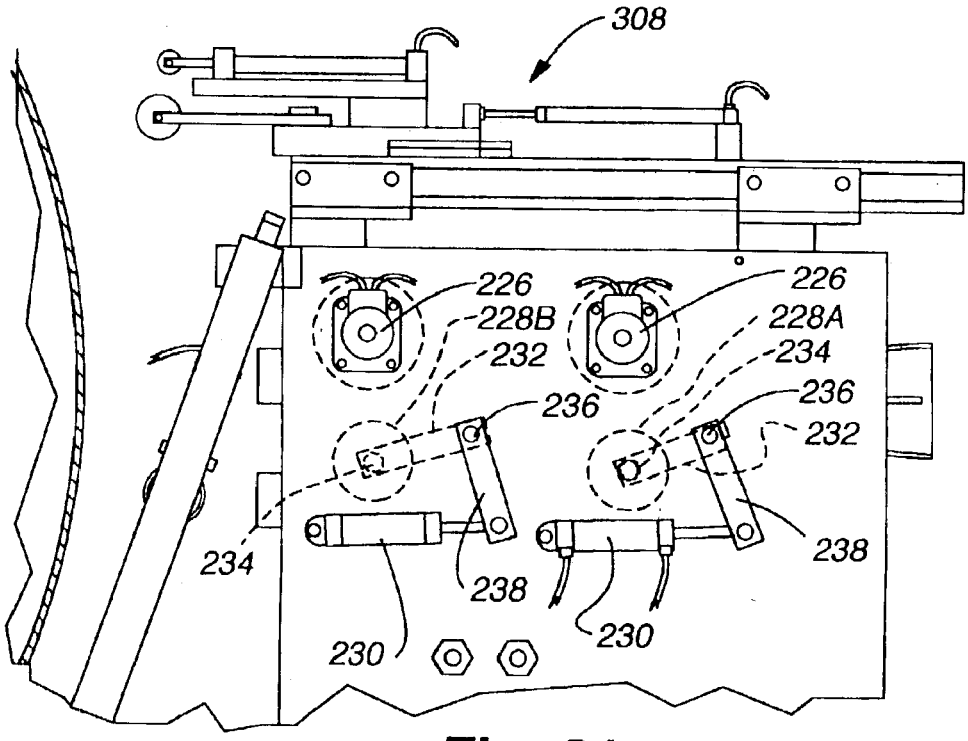
FIG. 21 is a similar view as FIG. 20 with the idler wheels in their retracted positions.

Referring primarily to FIGS. 16, 20 and 21, each idler wheel 228 is connected with a pneumatic cylinder 230 through several lever arms and associated pivotal connections for moving the wheels 228 between a nested position and a retracted position, wherein the tape can be threaded between the drive and idler wheels. Both idler wheels 228A and 228B are rotatably connected to one end of a generally horizontal lever arm 232 through a first axle member 234. The opposite end of each horizontal lever arm is fixedly secured to a second axle member 236. Each second axle member 236 passes through a bore in the vertically orientated framework of the folding section 200 that permits pivotal movement of the second axle therein. On the other side of the framework, each axle 236 is fixedly secured to one end of a generally vertical lever arm 238. The other end of each vertical lever arm 238 is pivotally attached to the end of a shaft of a pneumatic cylinder 230. The other end of each pneumatic cylinder is pivotally attached to the folding section framework. When either pneumatic cylinder is in its retracted position, the associated idler wheel 228A or 228B is in its normal position partially received in the recess of the drive wheel 220. When cylinder 230 is activated as shown in FIG. 21, the horizontal and vertical lever arms 232 and 238 pivot about the second axle member 236, thereby lowering the idler wheel 228A 228B away from the drive wheel 220.

Figure 23:
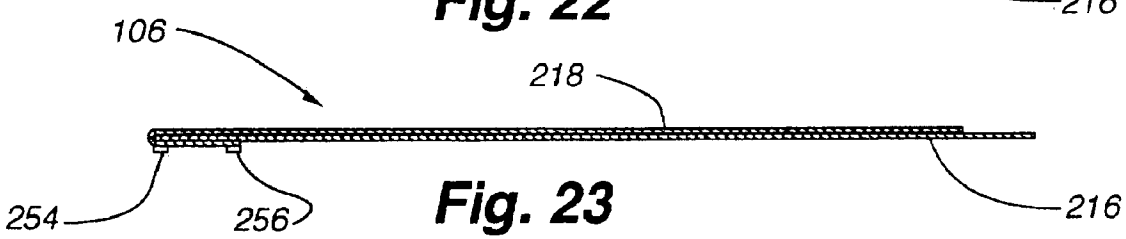
FIG. 23 is a cross sectional view of the folded tape with longitudinal adhesive beads applied as viewed along line 23—23 of FIG. 16.

Referring back to FIG. 16, the second adhesive applicator 222 is located between the two drive wheels 220 in the folding section 200. The adhesive applicator is coupled to the vertical framework of the folding section by way of a vertical adjustment mechanism 248, wherein the vertical position of the adhesive applicator's nozzles can be moved up and down by turning an adjustment knob 250 on the vertical adjustment mechanism. The second adhesive applicator 222 includes two spaced nozzles 252 positioned underneath and in contact with the bottom side 216 of the folded tape 106 as best seen in FIG. 13. The nozzles each apply a longitudinally orientated hotmelt adhesive bead 254 and 256 respectively to the folded tape. One adhesive bead 254 is located on the back side of the tape proximate the fold line, and the second adhesive bead 256 is spaced a short distance from the other. A cross sectional view of the tape 106 with the longitudinal adhesive beads applied to it is illustrated in FIG. 23. It is to be appreciated that the portion of the folded tape located between the longitudinal adhesive beads substantially forms the top or bottom side 20 of one cell 18 and the other of the top or bottom side of an adjacent cell 18.

Referring back to FIG. 16, a backing plate 258 is provided above the adhesive nozzles 252 against which the top side 218 of the folded tape 106 is positioned as it is pulled towards the bonding section 300. The plate 258 supports the tape as the adhesive beads 254 and 256 are applied to it to help ensure that the beads are longitudinally continuous. In a preferred embodiment, the backing plate 258 has a downwardly facing convex arcuate surface, wherein the lowest portion of the surface is located vertically below the vertical most portion of the idler wheels 228A and B over which the folded tape passed. Accordingly, the folded tape 106 is biased upwardly against the backing plate.

Referring to FIG. 16, after the adhesive beads are applied to the folded tape, the tape is pulled to the right by both the second drive wheel and the rotating drum 302. It is to be appreciated that in certain embodiments the surface of the second idler wheel 228B may include recesses proximate the location of the adhesive beads 254 and 256 to ensure that the beads are not compacted against the second idler wheel as it passes over the second idler wheel. From the second drive wheel 220, the tape is pulled into the bonding section.

FIG. 17 illustrates a variation of the folding section 200. As illustrated, the pneumatic cylinders 230 and lever arms 232, 238, 240 and 246 used with the idler wheels 228A and B to move the idler wheels away from the drive wheels 220 have been replaced with linear adjustment mechanisms 260 similar to the one described above with reference to the second adhesive applicator. By turning the knobs 262 on the vertical adjustment mechanisms, the idler wheels can be lowered away from the drive wheels 220. It is to be appreciated that the time necessary to move the idler wheels using the vertical adjustment mechanism is much greater than using a pneumatically controlled mechanism as illustrated in FIG. 16; accordingly, the pneumatic mechanism is typically preferred for production environments.

The nozzles of the adhesive applicator in the FIG. 17 variation are offset to the right of the backing plate 258, wherein the folded tape 106 is not backed by the plate at the location of the nozzles 252. The tension of the folded tape in the vicinity of the nozzles 252 is enhanced by the use of the backing plate 258 which is sufficient to maintain good contact between the bottom side 212 of the tape and the nozzles. It is to be appreciated that many variations in the manner in which the fabric tape is folded and the manner in which longitudinal adhesive beads are applied to the tape are contemplated, and that the illustrated embodiments are therefore merely exemplary.

The Bonding Section

The bonding section as shown in FIG. 4 comprises (1) the rotating drum 302 for receiving the folded tape 106; (2) a screw drive mechanism 304 for propelling the drum in its longitudinal direction at a prescribed rate; (3) a tensioning mechanism 306 for maintaining the tension of the folded tape as it is wrapped onto the drum; and (4) a pressurized roller assembly 308 for compacting the longitudinal adhesive beads 254 and 256 on the folded tape against a section of the continuous tape that was laid on the drum in the previous rotation. The bonding section is best illustrated in FIGS. 4–6, 16, 17 and FIGS. 24–29.

Referring primarily to FIG. 16, after exiting the folding section, the folded tape 106 with the parallel adhesive beads 254 and 256 deposited thereon is pulled both downwardly and to the right under and against a roller 310 of the tensioning mechanism 306 and then upwardly and to the right from the roller onto the surface of the drum 302. The roller 310 is rotateably coupled to a vertically orientated slide table 314 by way of an axle and bearing assemblies. The slide table 314 is mounted to a downwardly extending framework beam 318. A shaft 320 of a pneumatic cylinder 322 located on the beam above the slide table 314 is coupled to the moveable portion of the slide table, whereby pressurizing the pneumatic cylinder 322 biases the shaft 320 downwardly, encouraging the bottom of the roller 310 against the folded tape 106. A linear position transducer 324 is also attached to the moveable portion of the slide table for determining the linear position of the roller. The linear transducer is electrically coupled to the controller 400, which uses the positioning information to adjust the speed of the servo motors connected with the drive wheels 220 of the folding section 200 to maintain a uniform tape speed through all sections of the fabrication apparatus. The operation of the controller is discussed in greater detail in the controller section below.

Figure 24:
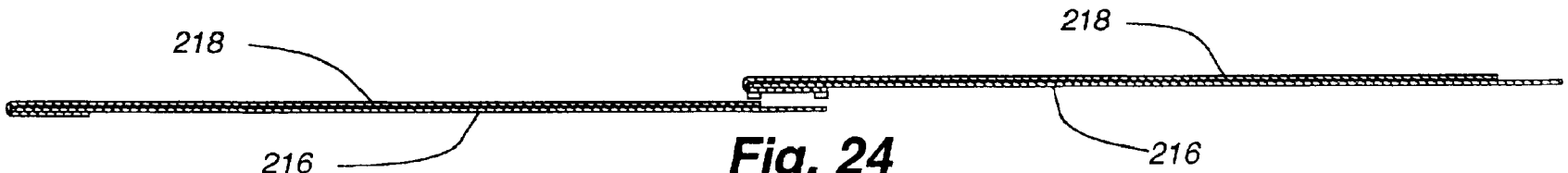
FIG. 24 is a cross sectional view of the folded tape illustrating one section overlapping another section as the folded tape is applied to the rotating drum.

From the tensioning roller 310 the rotation of the drum 302 pulls the tape 106 onto its surface. The drum also moves linearly in a direction along its longitudinal axis, i.e., in the direction perpendicular to its direction of rotation, at a speed that is both synchronized with and proportional to the rotational speed. As the tape is wrapped onto the drum, the portion of the tape with the longitudinal adhesive beads applied to it overlaps and is laid on top of a portion of the folded tape laid on the drum in the previous rotation. The configuration of the folded tape as it is laid onto the roller overlapping the previously laid section of tape is illustrated in FIG. 24. As shown, the adhesive bead 254, which is closest to the folded edge, overlaps and is placed against the top side 218 of the previously laid section, whereas the other adhesive bead 256 is placed over the overhanging flap of the bottom side 216 of the previously laid tape section.

Figure 25:
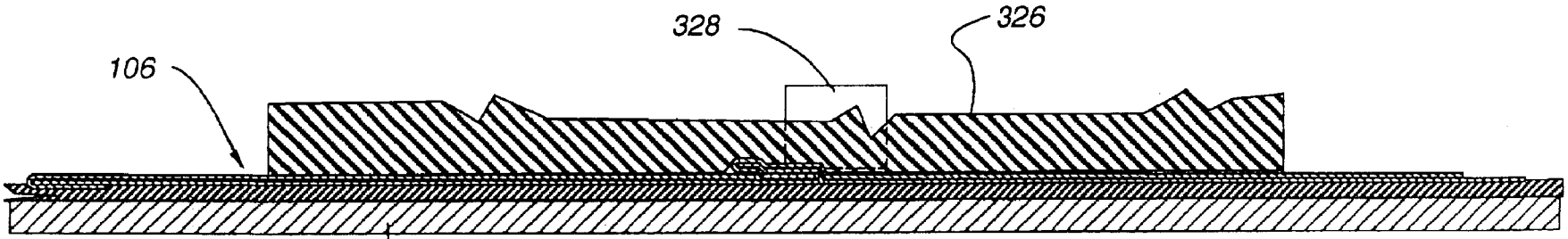
FIG. 25 is a partial cross sectional view taken along line 25—25 of FIG. 26 illustrating the contact between a roller and the surface of the tape on the rotating drum.
Figure 26:
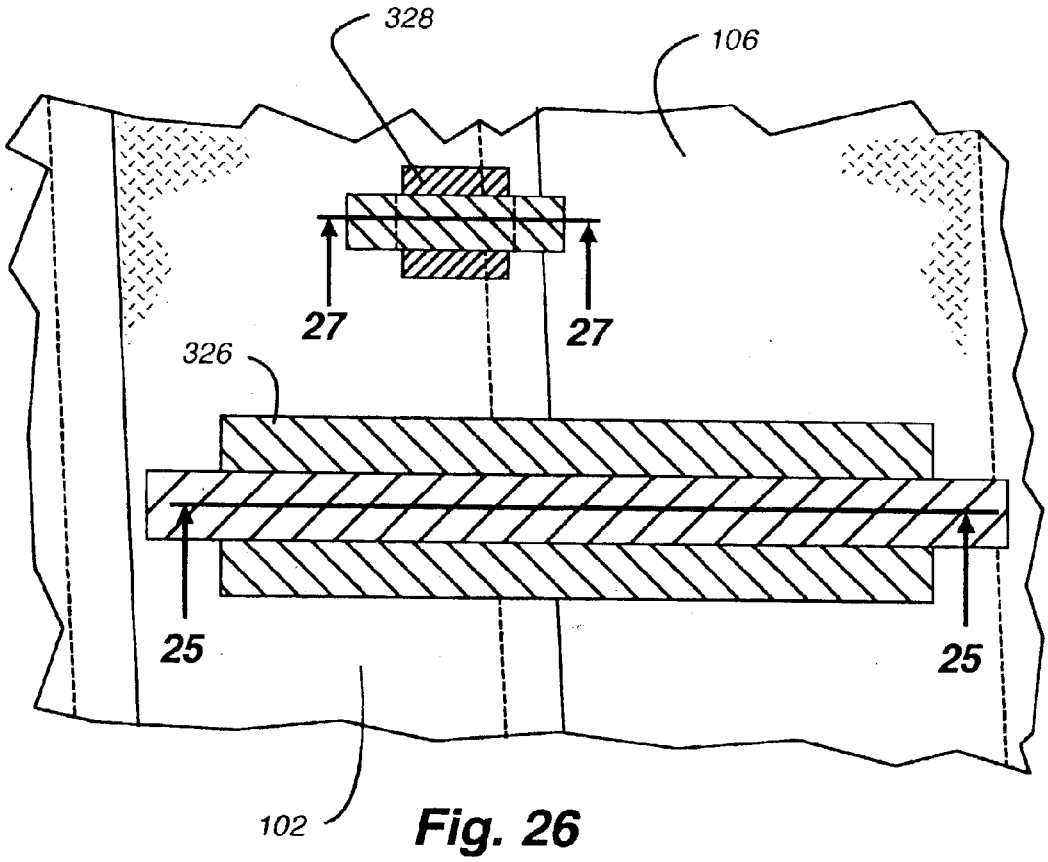
FIG. 26 is a view of the rollers of the pressurized roller assembly biased against the laid down tape as viewed along line 26—26 of FIG. 16.

As the drum 302 is rotated clockwise, the adhesive beads are compacted against the overlapped tape section by way of the pressurized roller assembly 308. In a preferred embodiment, as shown in FIG. 16, a two stage pressure roller assembly is specified, wherein a first roller 326 compacts both adhesive beads and a second roller 328 that compacts only the adhesive bead overlapping the flap portion of the previously laid tape section as illustrated in FIG. 25. Both the wider first roller 326 and the thinner second roller 328 are preferably fabricated of an elastomeric material, like rubber or silicone, that conforms to the surface of the drum 302 and the fabric tapes 106 contained thereon. The first roller 326 is rotatably attached to the right end of an arm 330 extending from the moveable portion 332 of a linear slide table 334. The other end of the moveable portion is secured to the shaft 336 of a pneumatic cylinder 338 with the cylinder's body being fixedly secured to the framework of the fabrication apparatus. In operation, the cylinder is pressurized to a specified level to bias the first roller against the overlapping portions of the tape as is shown in FIGS. 25 and 26.

Figure 27:
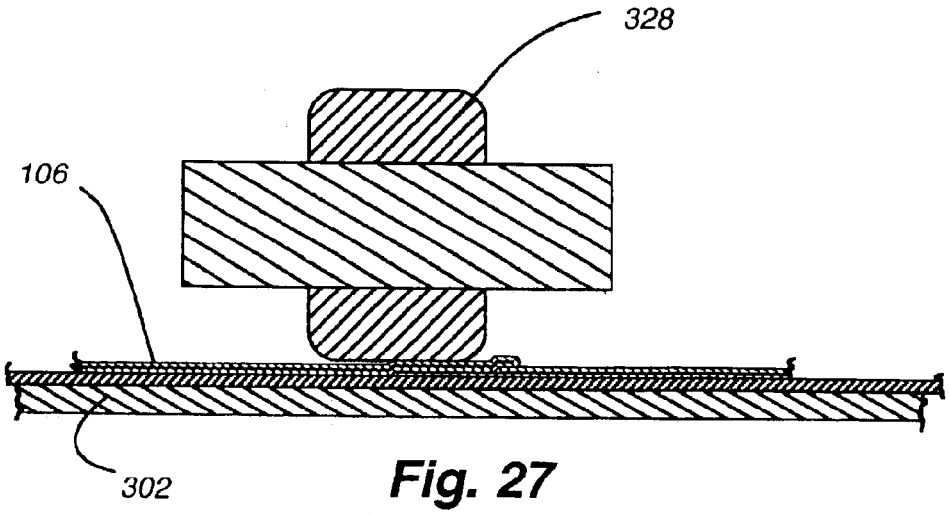
FIG. 27 is a cross sectional view of the small roller of the pressurized roller assembly in contact with the folded fabric tape on the drum as viewed along line 27—27 of FIG. 26.

It is appreciated that the adhesive bead 254 located in the thicker portion of the overlapping tapes (i.e. the bead overlapping the folded section of the previously applied tape) will have a greater amount of pressure applied to it than the other bead 256 located in the thinner portion of the overlapping section despite a degree of deformation of the elastomeric roller material. Accordingly, to help ensure the proper amount of pressure is applied to the other adhesive bead 256, the smaller second roller 328 is utilized. The second roller is attached to the shaft 342 of a second pneumatic cylinder 342 of the pressurized roller assembly 308. The body of the cylinder is mounted to the slide table 334. Pressurization of the pneumatic cylinder causes the smaller second roller 328 to be pressed against the adhesive bead 256 disposed over the flap portion of the bottom side 216 of the previously laid tape as shown in FIGS. 26 and 27, thereby ensuring a good bond between the newly laid tape and the previously laid tape.

In an alternative embodiment, as specifically shown in FIG. 17, only a single roller 326 is in the pressure roller assembly to compact the adhesive bead against the previously laid tape. A roller made of an elastomeric material with a low durometer is utilized to ensure the roller deforms sufficiently to apply bond pressure to both adhesive beads despite the height differences between where the two adhesive beads are disposed on the overlapping portion of the previously laid tape. The configuration of the single roller pressure roller assembly is substantially the same as the dual roller assembly save for the absence of the second roller and the pneumatic cylinder associated with the second roller.

As described above, the folded tape 106 is continuously wrapped around the drum 302 from one longitudinal end to the other. The drum is typically a relatively large diameter cylinder that is long enough to fabricate shade material that is long enough to cover most architectural openings over which it might be utilized. The diameter is typically large enough such that the width of the shade material fabricated (as measured by the drum's circumference) is at least as wide as the widest architectural opening over which the shade material may be utilized.

Further, the diameter must be large enough so that the differences in the length of the top side 218 of the folded tape 106 and the bottom side 216 of the folded tape is negligible when circumferentially wrapped a complete rotation around the drum. The length of the bottom side 216 of the folded tape is substantially equal to the product of diameter of the drum and Pi; whereas, the length of the top side 218 is substantially equal to the diameter of the drum plus twice the thickness of the bottom side of the folded tape times Pi. For tape material of a given thickness, it can be appreciated that the relative difference in length between the top and bottom sides of the tape increases as the diameter decreases. Large relative length differences can effect the appearance of the finished shade material. In the preferred embodiment, a drum 302 having a diameter of about 5' 3" and a length of about 9' is utilized.

Figure 28:
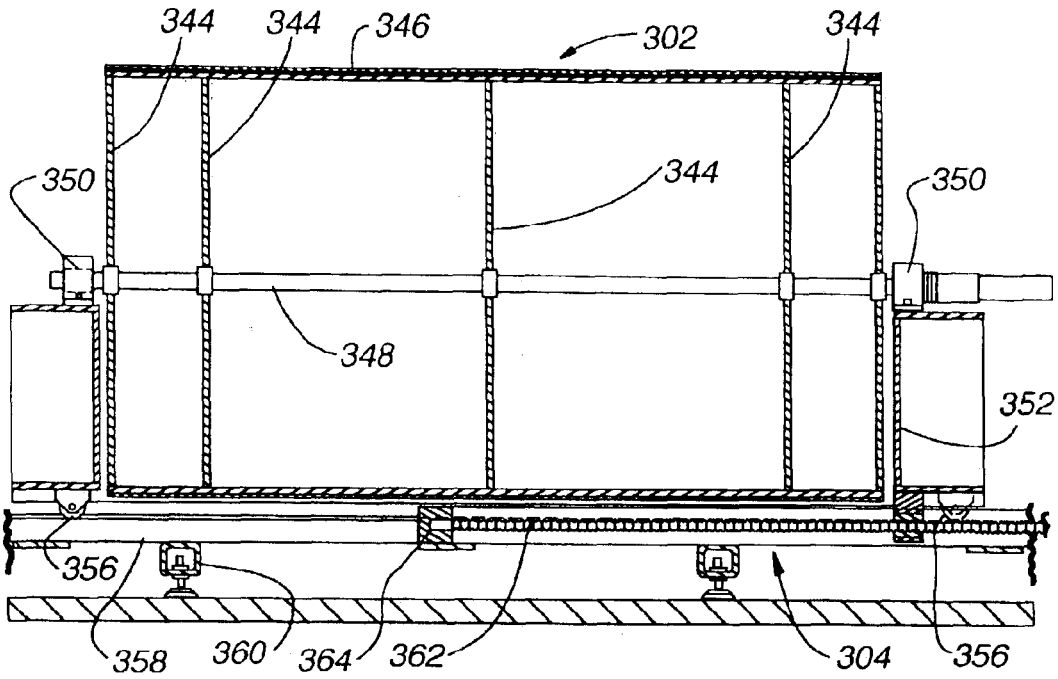
FIG. 28 is a cross sectional view of the drum taken along line 28—28 of FIG. 4.
Figure 29:
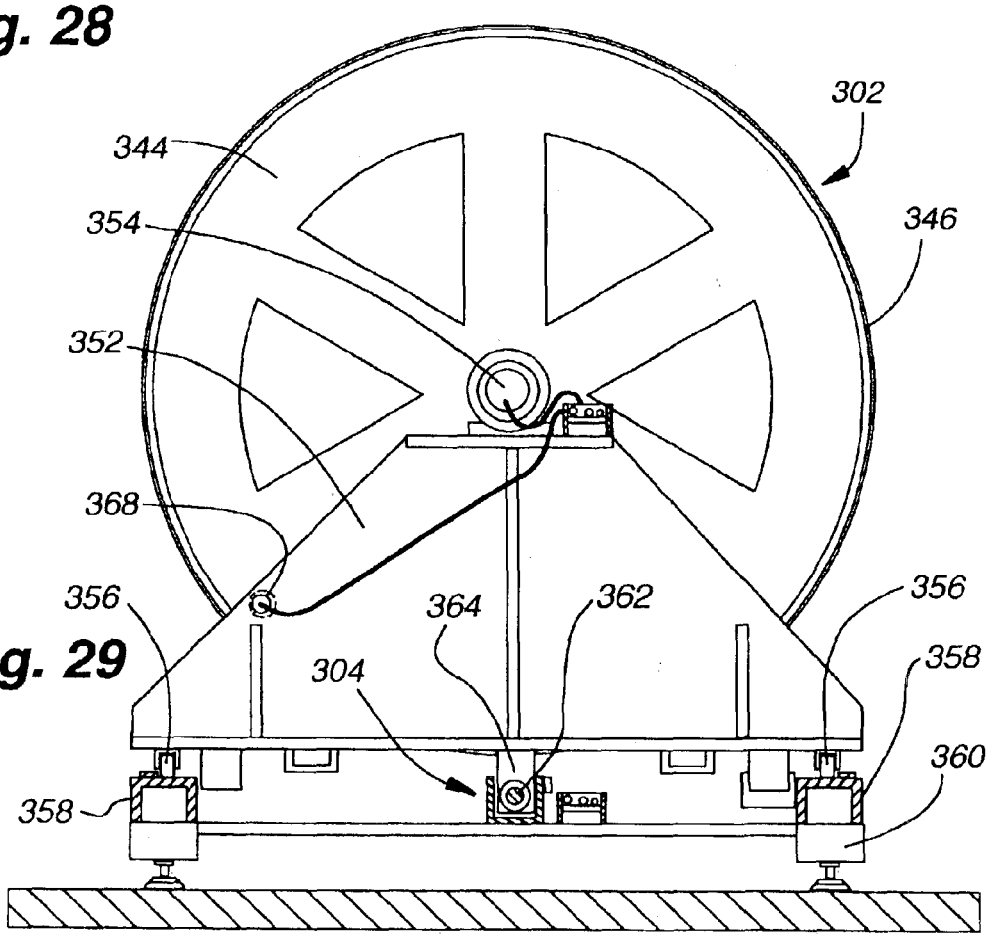
FIG. 29 is an end view of the drum taken along line 29—29 of FIG. 4.

The drum 302 may be fabricated from any number of suitable materials, although the drum must be uniformly round along its entire surface and it must be stiff enough to resist sagging longitudinally. In the preferred embodiment, as shown in FIGS. 28 and 29, the drum is fabricated from a plurality of spaced circular spoked steel plates 344 onto which a rectangular steel plate 346 is wrapped and welded. A Teflon coated fabric may be placed over the surface of the drum to help prevent the shade material from sticking to the surface due to any wayward adhesive material. A steel axle 348 extends down the length of the drum through the center of each of the spoked plates to which it is secured. The axle extends from each end of the drum, wherein each end is received in a bearing assembly 350 that permits the drum to rotate. Each bearing assembly is secured to one side of a wheeled platform 352. The wheeled platform supports the drum through the axle and bearing assemblies at either end of the drum.

Referring to FIGS. 4 and 28, the drum's axle 348 extends through the bearing assembly 350 at the right side of the wheeled platform 352 and is coupled to a servo motor 354, which rotates the drum. The drum servo motor 354, like the other servo motors, is coupled with the controller 400, which controls the speed and operating parameters of the motor. In the preferred embodiment, the drum servo motor serves as the master servo motor, wherein the speed of all the other servo motors are adjusted to synchronize with it to ensure the even flow of tape material through the fabrication apparatus.

The wheels 356 of the wheeled platform 352 rest on a pair of rails 358 of a base platform 360 as best shown in FIGS. 28 and 29. The wheels 352 are orientated to permit movement of the wheeled platform 352 and the drum 302 along the rails 358 in the longitudinal direction of the drum. To facilitate the controlled longitudinal movement of the wheeled platform, a screw drive 304 is utilized. The screw drive comprises an elongated screw 362 rotateably attached to the base platform that extends underneath the wheeled platform parallel to the drum. The screw 362 is coupled with the wheeled platform by way of a tab 364 that extends downwardly from the wheeled platform, wherein the screw passes through a threaded bore in the tab. By turning the screw the wheeled platform is encouraged to move one way or the other depending on the direction of the screw's rotation. A servo motor 366 is coupled with one end of the screw 362 to rotate the screw. The screw servo motor 366 is also coupled to the controller 400 and like the other servo motors 122 and 226 is synchronized with the drum servo motor 354 so that the wheeled platform and the drum move only a specified longitudinal distance amount for each rotation of the drum.

Controller Operation of the Fabrication Apparatus

Up to five servo motors 122, 226 and 354 are utilized to feed the tape material from the fabric rolls 102 to its final position on the drum 302 as part of the cellular roller shade material 12. Another servo motor 366 is provided to move the drum linearly to ensure so that the folded tapes 106 overlap properly as they are laid onto the drum. It is imperative to the proper operation of the fabrication apparatus that the servo motors are all synchronized properly to ensure even tension is maintained on the tape(s) throughout the various sections of the fabrication apparatus. The computerized controller 400 acts to constantly monitor the operation of the various sections of the fabrication apparatus and adjust the various speed of the servo motors as necessary.

Ideally, the tension applied to the tapes as they are pulled through the fabrication apparatus is held at the lowest possible levels that are sufficient to facilitate: (1) the proper and continuous application of adhesive to the tape 104B, which forms the rear sides 24 of cells 18, prior to bonding to the tape 104A, which forms the front sides 22 of the cells 18; (2) the straightness of both tapes 104A and 104B as they are joined so that no folds or creases are introduced into the joined tape 106; (3) the continuous application of the longitudinal parallel adhesive beads 254 and 256 to the folded tape 106; and (4) the flat lay down of the folded tape 106 on the drum 302 without introducing any anomalies that could affect the uniformity of the finished cellular shade material 12. It is to be appreciated that too much tension can cause problems such as elastic and plastic stretching of the fabric tapes that result in unevenness of the cells when the tension is released by removing the shade material 12 from the drum 302.

To help maintain a constant tension throughout the fabrication apparatus, several tension mechanisms 126 and 306 are provided. As described in detail above, each tensioning mechanism generally comprises a spindle or roller that is moveably attached to a linear slide table and have a pneumatic cylinder attached to them to provide the necessary tensioning force. The slide table allows the spindle or roller to move in response to small changes in the speed of the servo motors without causing the tension level throughout the fabrication apparatus to change. It can be appreciated that if the slide tables are allowed to be fully extended to either of their ends, the tension in the system could change to levels above or below the preferred level resulting in a degradation of the resulting roller shade material 12. Accordingly, linear position transducers are provided at each of the tensioning mechanisms. The transducers are coupled to the controller 400 and provide the controller with position information that the controller utilizes to adjust the speed of the various servo motors to help maintain the spindle or roller attached to a tensioning mechanism near the middle of the associated linear slide table's range of travel.

To complicate matters, as the tape material is unwound from either roll 102 of fabric tape, the amount of fabric tape 104 unwound for a given servo motor speed decreases with the change in circumference of the roll. Accordingly, the associated servo motors' speeds must be constantly increased to continue to supply the fabric tapes 104 at constant rates. As mentioned above, ultrasonic sensors 124 are provided to measure the distance between the sensors and the surface of the associated rolls 102. The computer controller utilizes this information to determine the circumference of the rolls so that it can adjust the speed of the associated servo motors 122 to maintain the unwind rate at the same rate at which the folded tape 106 is deposited on the drum 302.

Figure 30:
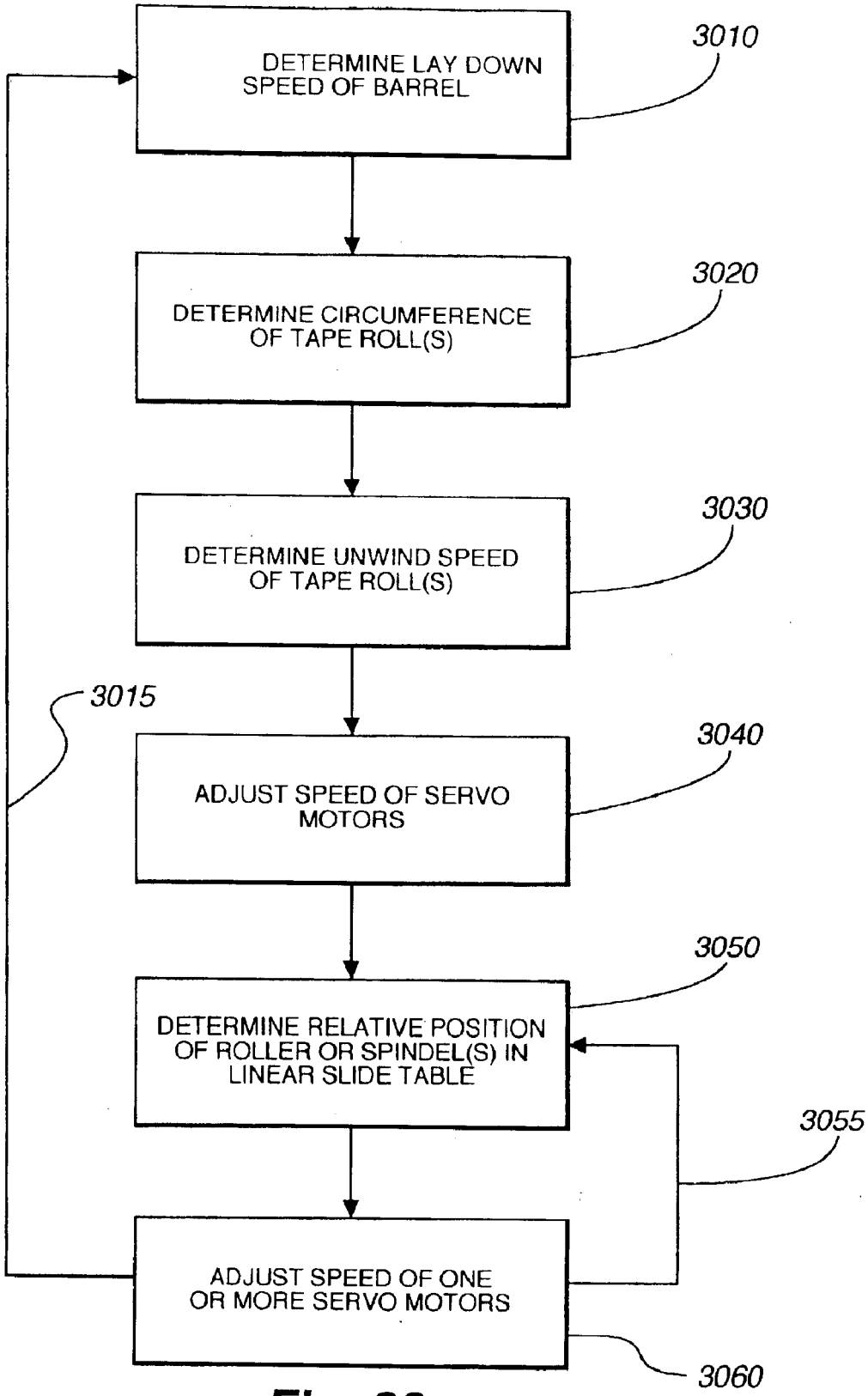
FIG. 30 is a flow diagram of a controller algorithm of the preferred embodiment.

FIG. 30 is a flow chart illustrating the operation of the controller for a preferred embodiment of the invention. It is understood that other algorithms can be utilized to accomplish the result of maintaining the even flow of tape through the system at a constant tension and that the illustrated algorithm is therefore merely exemplary.

Referring to block 3010, the rate that the folded tape 106 is laid down on the drum 302 is determined. The lay down rate is a function of the circumference and rotational speed of the drum. The rotational speed of the drum can be determined using a photovoltaic sensor 368 that is triggered each time the drum completes a rotation or the speed of the fifth servo motor can be utilized to determine the drum's rate of rotation.

In block 3020, the distance between each ultrasonic sensor 124 and its associated roll 102 of fabric tape 104 is determined. Based on a known distance between each sensor and the center of the associated turntable 114, the radius, diameter and circumference of the tape rolls are determined.

In block 3030, using the circumference of the tape rolls and the rotational speed of the associated servo motors 122, the unwind rates of the rolls of fabric tape are determined.

In block 3040, the unwind rate of both rolls 102 are compared to the lay up rate of the folded tape 106 on the drum. Both unwind rates should be the same as the lay up rate. As necessary, the rotational speeds of the servo motors 122 are adjusted. Typically, the speed of the servo motors 122 are increased to account for the decrease in diameter of the associated rolls 102 of fabric tape.

It is to be appreciated that the rotational speeds of folding section drive wheel servo motors 226 and the screw servo motor 366, which all operate a speed proportional to the drum servo motor 354, may also be determined and adjusted as necessary. In general, however, when the fabrication apparatus is at full operational speed (250–300 ft/min), adjustment to the speeds of screw servo motor is rarely needed, and necessary adjustments to the speed of the drive wheel servo motors are typically very small and are based on the position of the tensioning roller 310 of the tensioning mechanism 306 as described below. However, when the fabrication apparatus is ramping up to operational speed during startup or slowing down as the fabrication apparatus is being shut down, the speed of the servo motors 226 and 366 will be adjusted to maintain proportionality with the drum servo motor.

Referring to block 3050, the positions of the spindles 130 of the supply section tensioning mechanisms 126 are determined based on the position of the moveable portion 140 of the linear slide tables 138 as measured by the linear position transducers 144. It can be appreciated that adjustments to the speed of either turntable servo motor 122 based on the circumferences of the respective rolls 102 of fabric tape as performed in block 3040 are relatively coarse being dependent on the tension at which the fabric rolls were originally wrapped, the uniformity of the fabric tapes, and the roundness of the rolls. Due to the coarseness of the speed adjustment based only on the circumference of the rolls, too much or too little tape may be unwound from the fabric tape rolls causing the spindles 130 to move in the linear slide tables 138 to maintain a constant tension.

More precise adjustments to the speed of the servo motors are necessary to account for these variations. The controller 400 is directed to maintain the spindles 130 of the tensioning mechanisms 126 near the center of the linear slide tables 138. Accordingly, in block 3060, the speed of the turntable servo motors 122 are adjusted to move the spindles back towards their center position. For example, if the circumference of a roll was determined using the ultrasonic sensor to be slightly larger than it actually was, less material would be unwound from the tape roll than necessary to maintain an unwind rate identical to the lay up rate. This will cause the spindle 130 to move in the direction of the stationary spindles 128 and 132 of the associated tensioning mechanism 126 providing the necessary extra tape to maintain the uniform tape tension. As the spindle 130 moves away from its center position, the movement is registered by the controller through the linear position transducer 144, and the controller increases the rotational speed of the associated servo motor 122 slightly to cause the spindle 130 to move back towards its center position.

Referring back to block 3050, The position of the tensioning roller 310 in the bonding section's tensioning mechanism 306 is measured by the associated linear position transducer 324. Movement of the roller 310 can be caused if either of the drive wheel servo motors 226 are pulling the folded tape through their associated drive wheels 220 at a rate that is different than the lay up rate on the drum 302. As mentioned above, the speed of these servo motors 226 does not typically need much adjustment, however, small variations in the rate at which the tape is pulled through the drive wheels 220 may result due to slippage of the folded tape 106 in-between the drive and idler wheels 228 caused by small variations in the composition and dimensions of the folded tape. As necessary, the speed of the drive wheel servo motors 226 is adjusted to cause the roller 310 to move back to its normal position at the middle of the slide table 314.

As indicated by line 3055, the position of the spindles 130 and the roller 310 is continuously monitored and speed adjustments are continuously made to the servo motors based on the positions of the spindles and the roller in their respective slide tables 138 and 314. Further as indicated by line 3015, the lay down speed of the folded tape 106 at the drum 302 and the circumferences of the tape rolls 102 are continuously monitored with speed adjustments being made to the turntable servo motors 114 as necessary.

A First Alternative Embodiment

A first alternative embodiment of the fabrication apparatus is illustrated in FIGS. 31–37. As shown in FIGS. 31–34, the supply and folding sections 100 and 200 of the first alternative embodiment are substantially the same as the similar sections described above with reference to the preferred embodiment. The first alternative embodiment differs from the preferred embodiment primarily in the use of a conveyor belt assembly 402 in place of the drum over which the folded tape 106 is assembled into cellular shade material 12.

Figure 31:
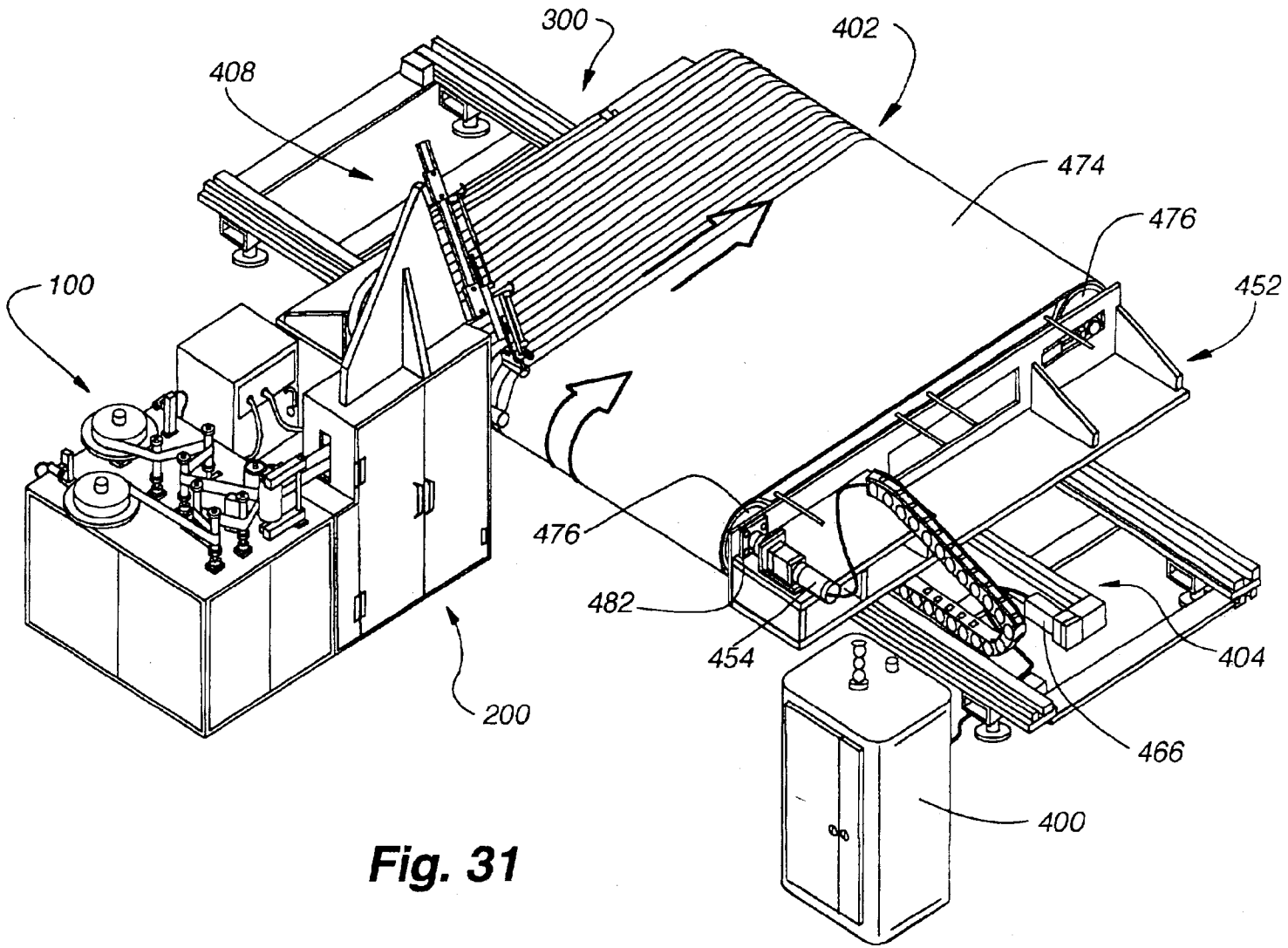
FIG. 31 is an isometric view of the first alternative embodiment fabrication apparatus.
Figure 32:
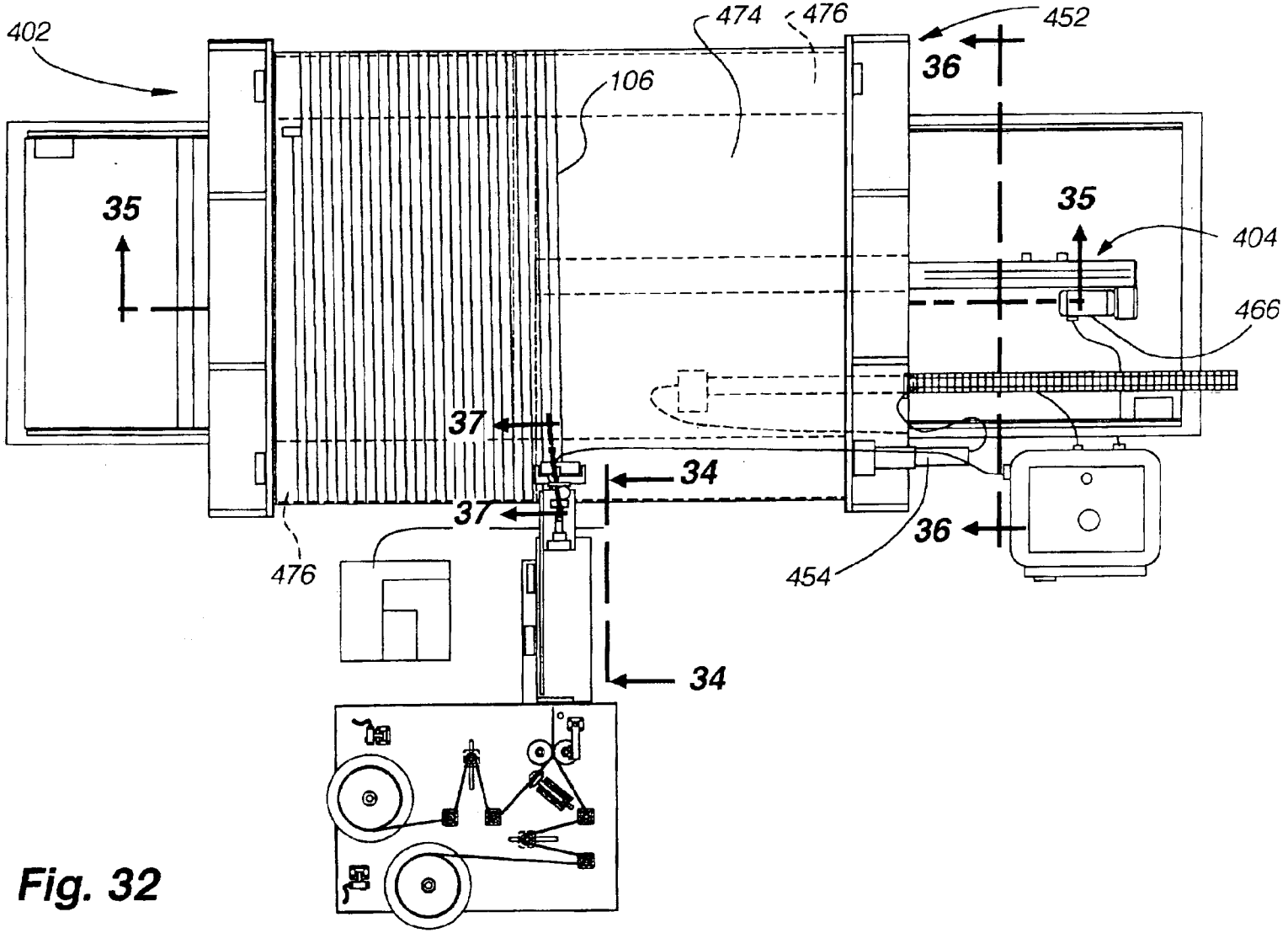
FIG. 32 is a top view of the first alternative embodiment fabrication apparatus.
Figure 33:
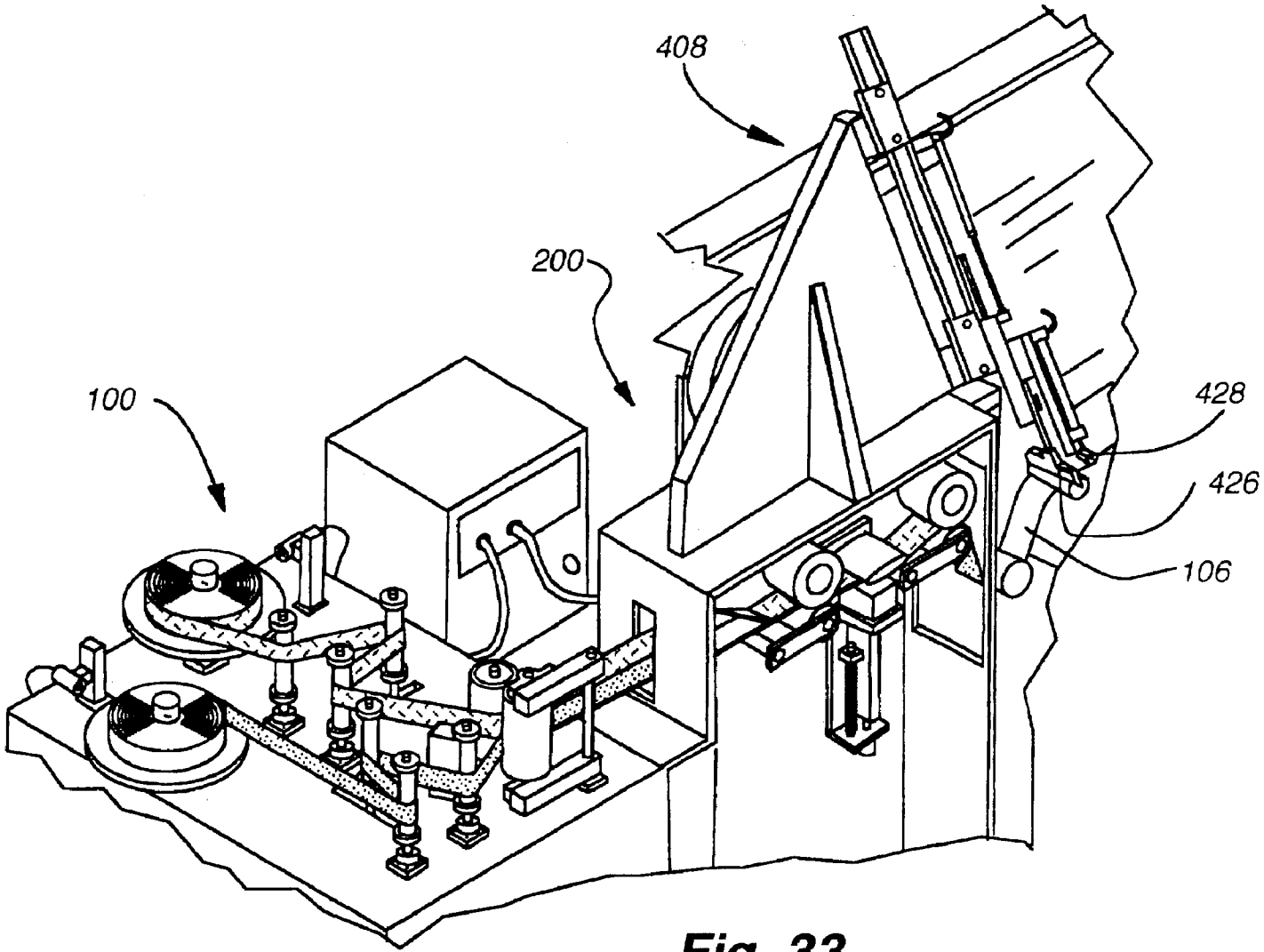
FIG. 33 is a partial isometric of the first alternative embodiment fabrication apparatus primarily illustrating the supply and folding sections.
Figure 37:
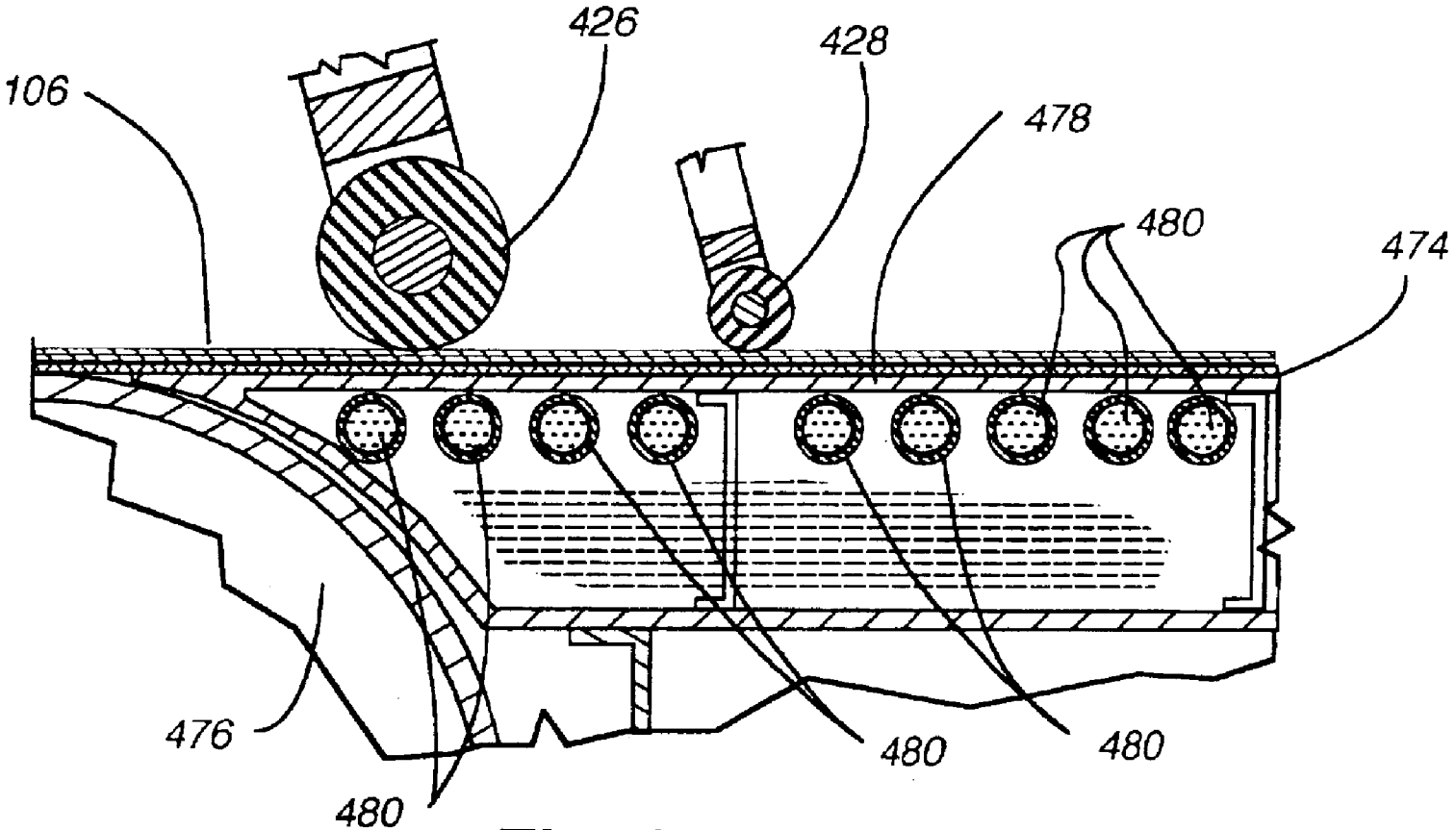
FIG. 37 is a partial cross sectional view of the conveyor belt assembly and the pressurized roller assembly as taken along line 37—37 of FIG. 32.
Figure 38:
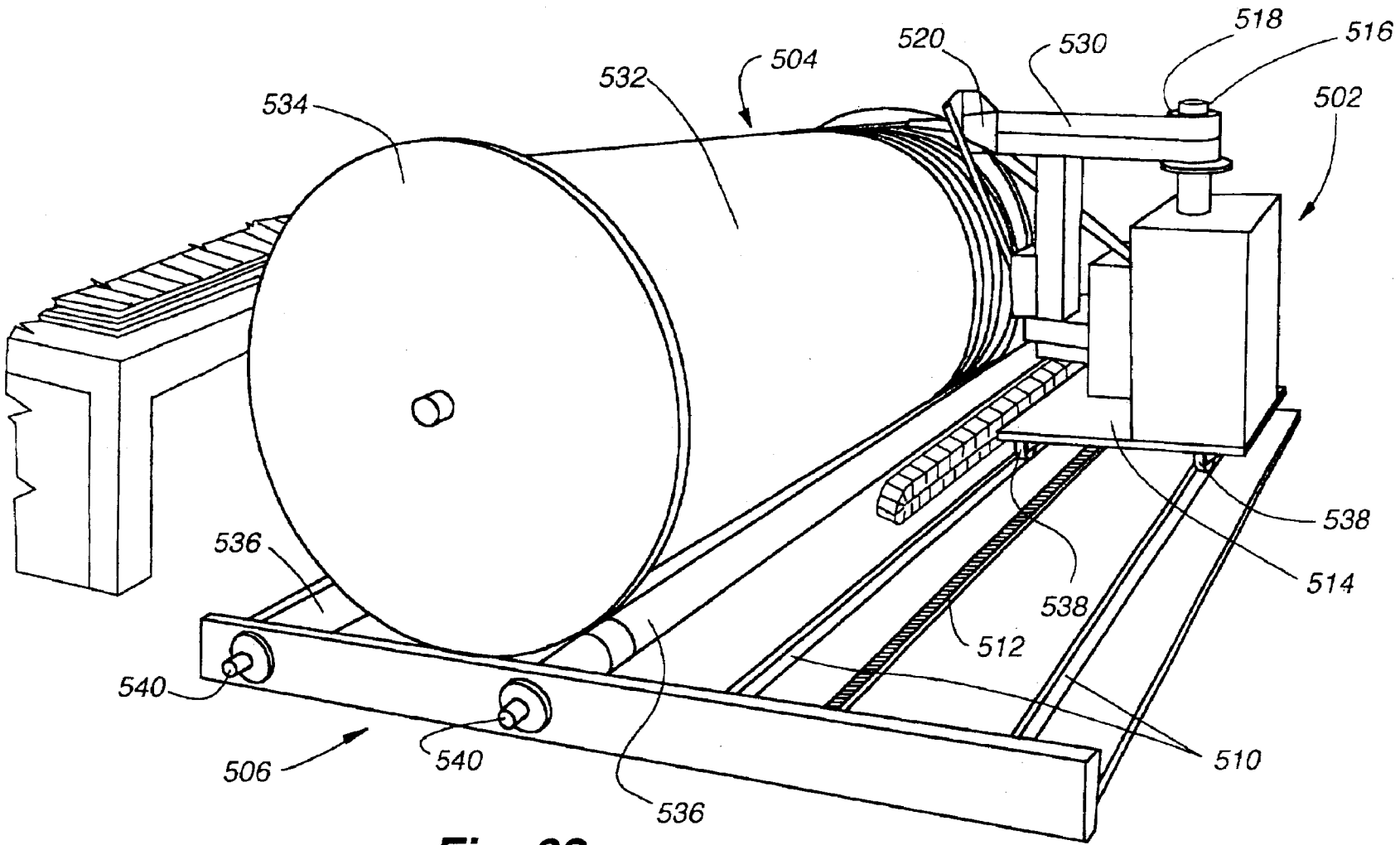
FIG. 38 is an isometric view of the second embodiment fabrication apparatus.

Referring to FIGS. 31, 32, 35 and 36, the conveyor belt assembly 402 typically comprises a tubular belt 474 of reinforced fabric that is tensioned about a pair of parallel spaced elongated cylinders 476. The cylinders are rotateably attached to the ends of a wheeled platform 452. The wheeled platform includes a substantially planer support plate 478 located between the two cylinders just beneath conveyor belt 474 to provide support to the belt when the belt is subjected to downwardly-directed forces such as those imparted by the rollers 426 and 428 of the pressure roller assembly 408 (as shown in FIGS. 31, 37 and 38). As illustrated in FIG. 37, cooling lines 480 for circulating water or another cooling fluid may extend beneath the support plate 478 to facilitate the cooling and solidification of the hot melt adhesive after sections of the folded tape 106 are joined together.

Referring to FIG. 31, a belt drive motor 454 is attached to the axle 482 of one of the cylinders to rotate the cylinder and cause the conveyor belt 474 to move in the indicated direction. Like the drum servo motor 354 of the preferred embodiment, the belt drive motor (also a servo-type motor) is coupled with the controller, which controls its operating speed. Also, like in the preferred embodiment, the speeds of the other servo motors of the fabrication apparatus are all synchronized relative to the speed of the belt drive motor 454. In this regard, the operation of the controller is substantially the same as described above for the preferred embodiment.

Figure 35:
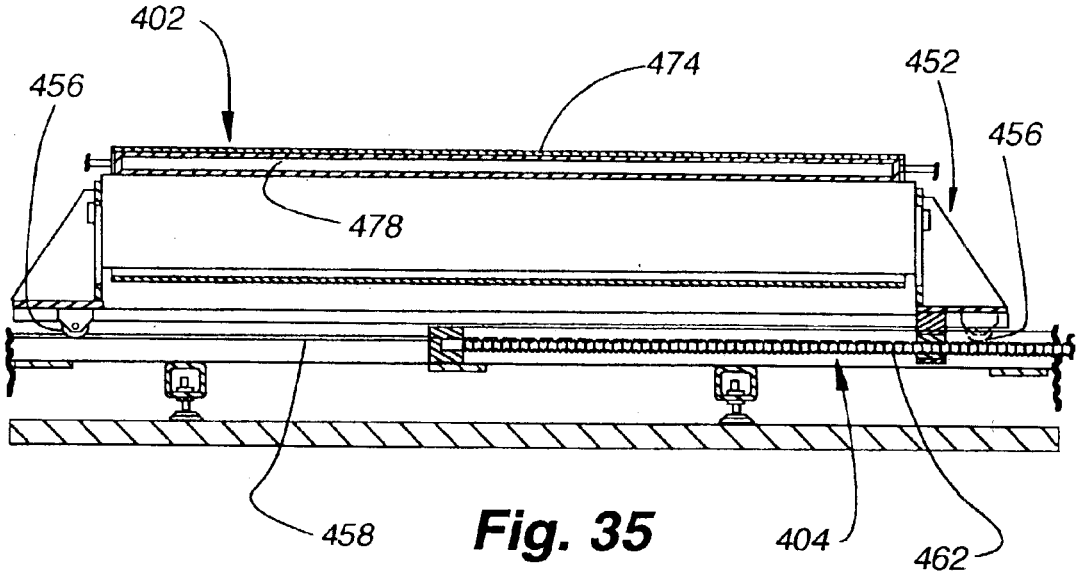
FIG. 35 is a cross sectional view of the conveyor belt assembly taken along line 35—35 of FIG. 32.
Figure 36:
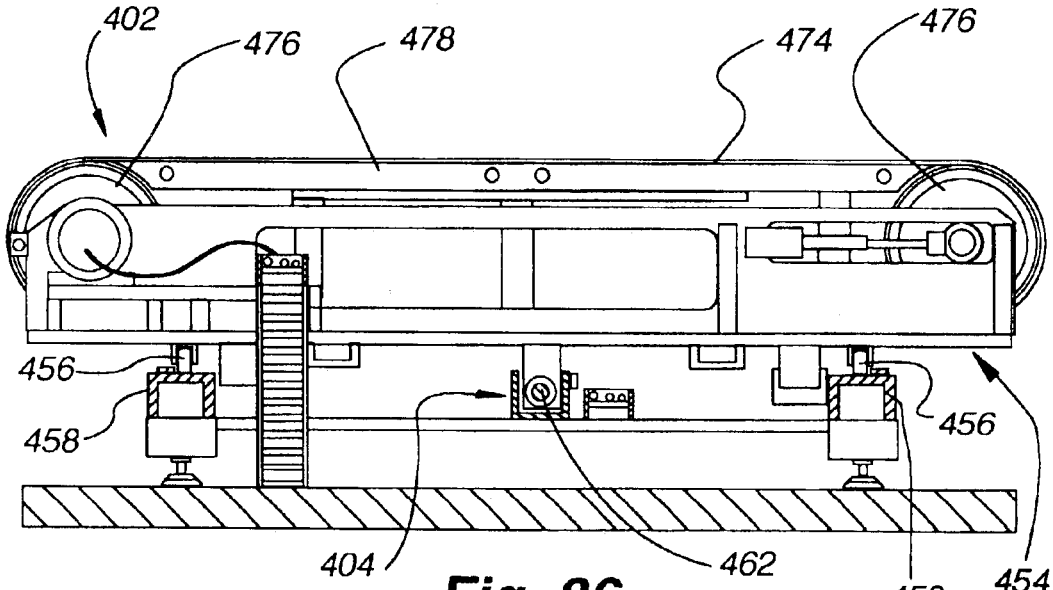
FIG. 36 is a side view of the conveyor belt assembly taken along line 36—36 of FIG. 32.

Referring to FIGS. 35 and 36, the wheels 456 of the wheeled platform 452 rest on a pair of rails 458 facilitating linear movement in a direction substantially perpendicular to the direction of rotation of the conveyor belt 474. A screw drive mechanism 404 similar to the mechanism described in the preferred embodiment is provided for controlling the linear movement of the wheeled platform along the base platform's rails. A servo motor 466 that is synchronized to the drive motor 454 of the conveyor belt 474 is attached to the screw 462 to move the conveyor belt at a certain rate to ensure the proper overlap of the consecutive sections of the folded tape 106.

Figure 34:
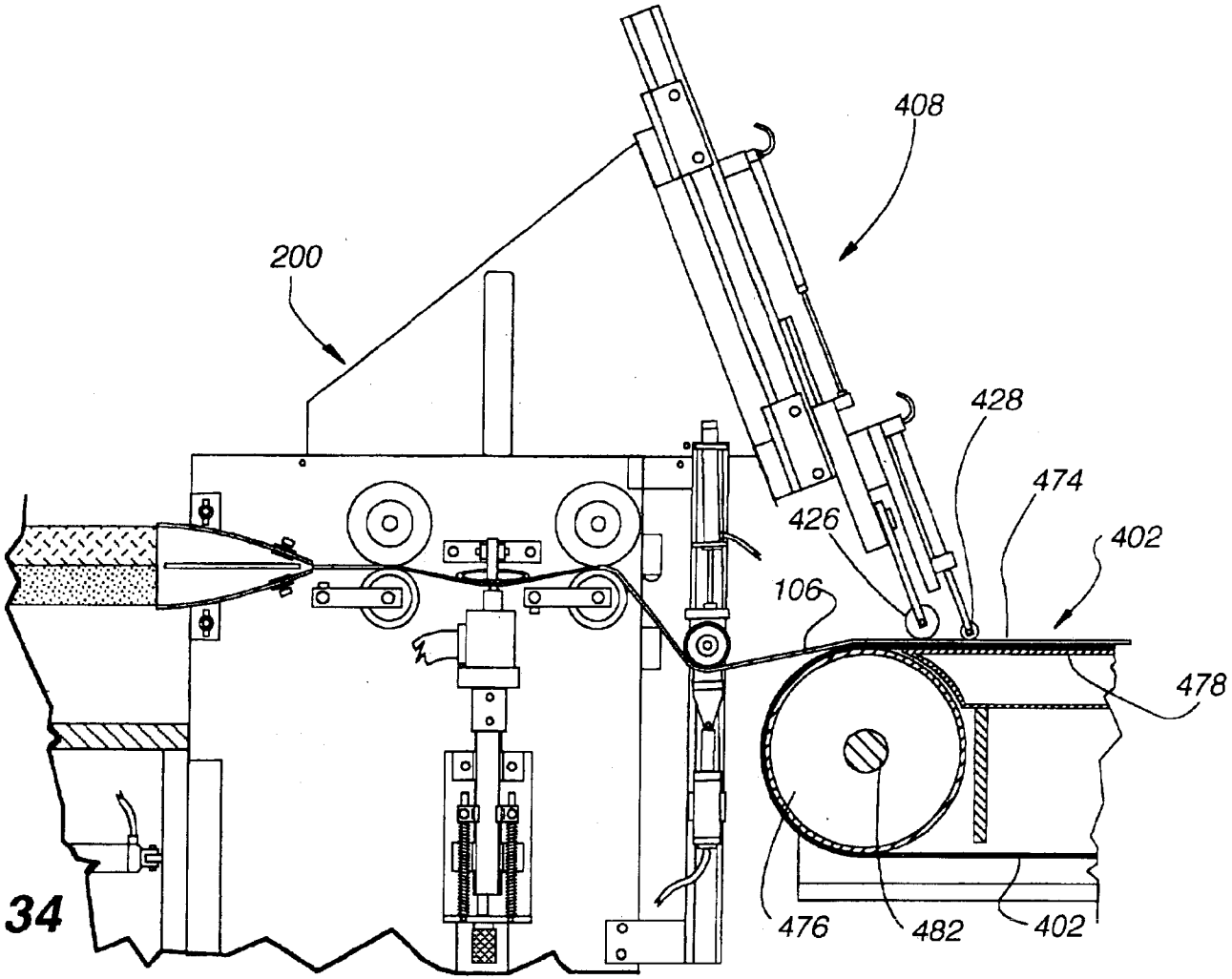
FIG. 34 is a side view of the folding section of the first alternative fabrication apparatus as viewed along line 34—34 of FIG. 32.

Referring primarily to FIG. 34, the pressurized roller assembly 408 of the first alternative embodiment is similar to the same assembly in the preferred embodiment except the assembly of the first alternative embodiment is canted downwardly so that the small and large rollers 426 and 428 impact the conveyor belt when the belt is substantially horizontal as it exits the first cylinder. As previously mentioned, the support plate 478 provides support to ensure the pressure applied by the rollers is effective in compacting the adhesive beads 254 and 256 and forming a suitable bond.

A Second Alternative Embodiment

The second alternative embodiment is substantially different from both the preferred and first alternative embodiments and is illustrated in FIGS. 38–42. Essentially, the second alternative embodiment is a simplified fabrication apparatus compared to the other two embodiments, wherein only two motors are utilized and no complex computer control system is necessary to fabricate the cellular shade material 12. The second alternative embodiment includes (1) a tape deposition cart 502 with implements for folding the fabric tape 106 and applying adhesive beads 554 and 556 to join the tape to previously laid sections of tape; (2) a rotating elongated cylindrical drum 504 for receiving the adhesive-laden folded tape; and (3) a base 506 on which the drum and cart are received including a drive motor 508 for rotating the drum and parallel recessed tracks 510 and a rack 512 with gear teeth gear for controlling the linear movement of the tape deposition cart.

Figure 39:
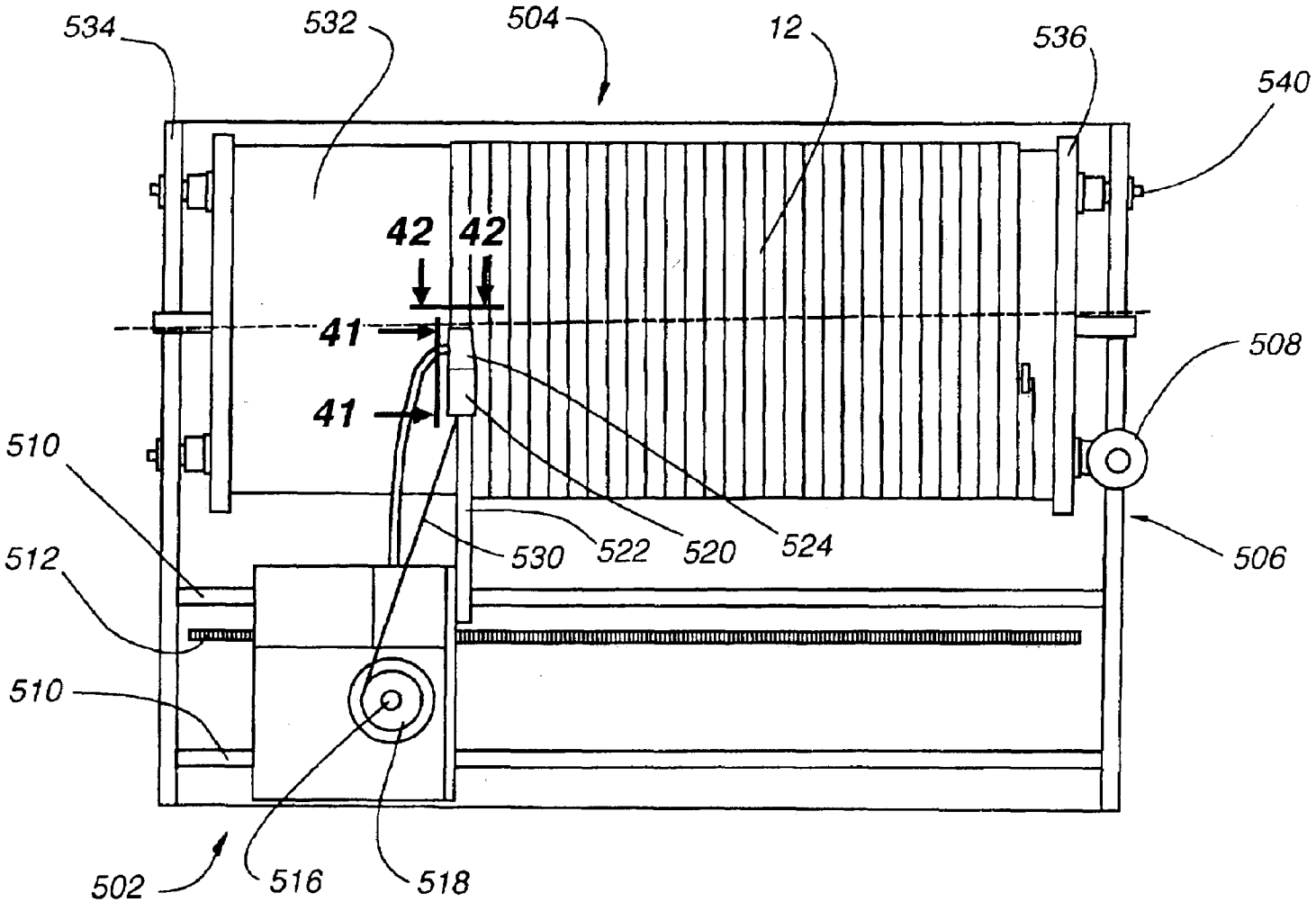
FIG. 39 is a top view of the second embodiment fabrication apparatus.

Referring to FIGS. 38 and 39, the cart comprises: (1) a wheeled base 514; (2) a vertically projecting spindle 516 for rotationally receiving a roll of fabric tape material 518; (3) a tape folding horn 520 connected to the base by a generally horizontally extending arm 522; (4) an adhesive applicator 524 mounted at the end of the arm in front of the folding horn; and a drive motor 526 with an associated pinion gear 528 for moving the cart in a linear direction parallel to the drum. The prejoined tape 530 from the roll 518 extends from the vertical spindle to the folding horn. The folding horn is similar in construction to the horn described in reference to the preferred embodiment. The horn folds the vertically oriented tape along a fold line parallel to but offset from the longitudinal center line of the tape 530. Upon exiting the horn, the folded tape is horizontally disposed with a portion of the bottom side of the folded tape extending beyond the free edge of the top side.

Figure 42:
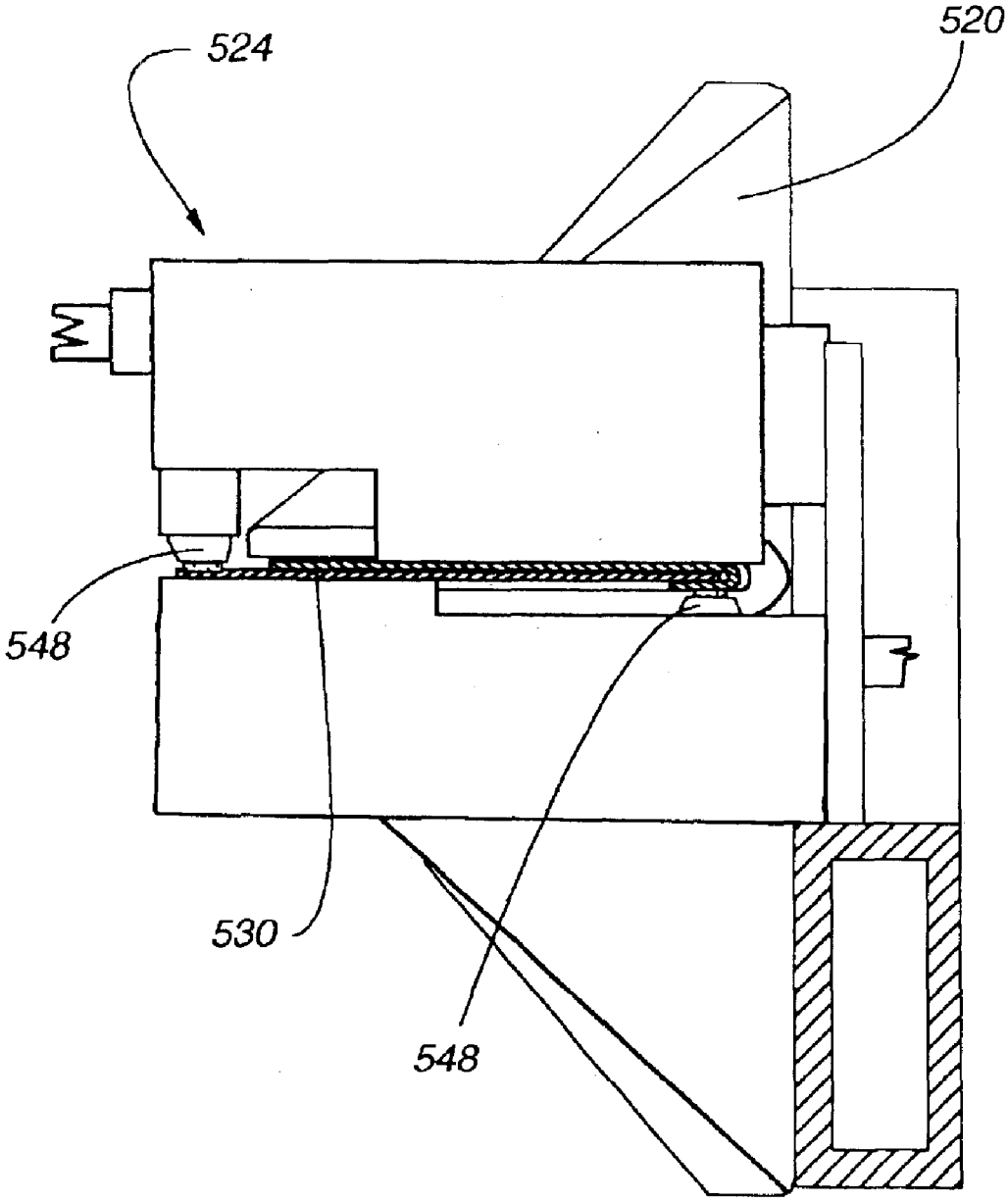
FIG. 42 is an end view of the adhesive applicator for the second embodiment fabrication apparatus as viewed along line 42—42 of FIG. 39.

Next, referring to FIG. 42, the nozzles 548 of the adhesive applicator apply one adhesive bead 550 to the top surface of the overhanging portion of the folded tape and one bead 552 to the bottom side of the folded tape. This is in contrast to the previously described embodiments, wherein both adhesive beads are applied to the bottom side of the folded tape proximate the folded edge.

Figure 43:
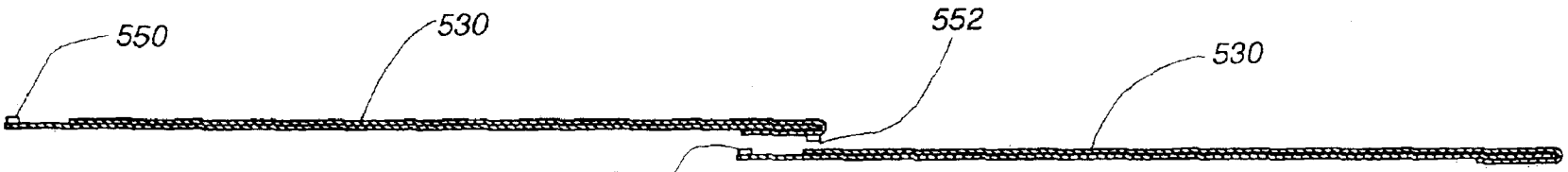
FIG. 43 is a cross sectional view of the folded tape from the second alternative embodiment illustrating one section overlapping another section as the folded tape is applied to the rotating drum.

Finally, the tape is deposited onto the rotating drum, wherein the tension of the tape combined with the downward direction of the drum after the tape is applied pushes the bead into contact with the previously laid section of tape. FIG. 43 illustrates how the folded tape 530 overlaps the previously laid section of tape to create the cellular shade material.

Figure 44:
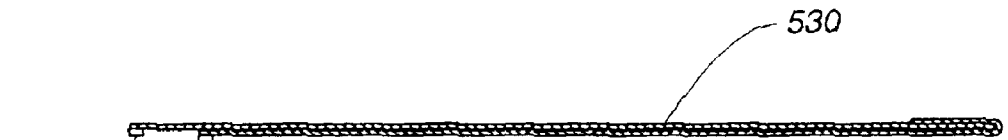
FIG. 44 is a cross section of a folded tape with the adhesive beads applied to bottom surfaces proximate the open edges of the tape.
Figure 45:
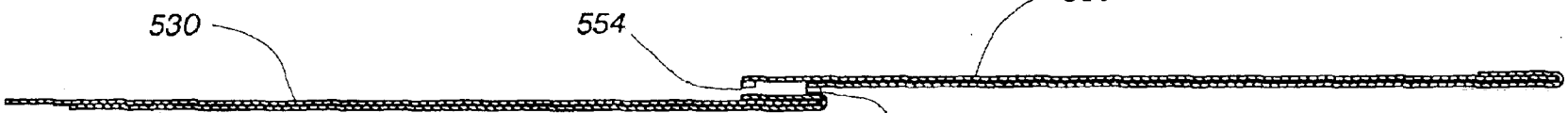
FIG. 45 is a cross sectional view of the folded tape of FIG. 44 illustrating one section overlapping another section as the folded tape is applied to the rotating drum or a conveyor belt.

It is to be appreciated that despite the different points of application of the adhesive beads in the preferred embodiment versus the second alternative embodiment, the resulting cellular shade material is substantially the same. It can also be appreciated that the adhesive may also be applied to other locations on a folded tape and still create the cellular shade material 12. For example, as shown in FIGS. 44 and 45, the fabric tape 530 is flipped in orientation when compared to the preferred embodiment with the overlapping flap on the top side. In this example, one bead of adhesive 554 is applied to the bottom surface of the flap and another adhesive bead 556 is applied to the bottom surface of the bottom side proximate the bottom side's open edge. The adhesive beads are laid against the folded edge of a previously laid section as shown in FIG. 46, resulting in a cellular shade material substantially the same as created using the adhesive applicators of either the preferred or second alternative embodiments.

The elongated drum 504 is best shown in FIGS. 38 and 39. The drum includes a central portion 532 with a surface onto which the folded tape 530 is laid to form the cellular shade material 12, and two end caps 534 that have a greater diameter than the central portion. The circumferential edges of the end caps support the drum against two elongated rollers 536 of the base 506 as the drum is rotated. In one variation of the second embodiment, the drum includes a center axle through which the drum is supported in bearing assemblies above the bottom surface of the base.

Figure 40:
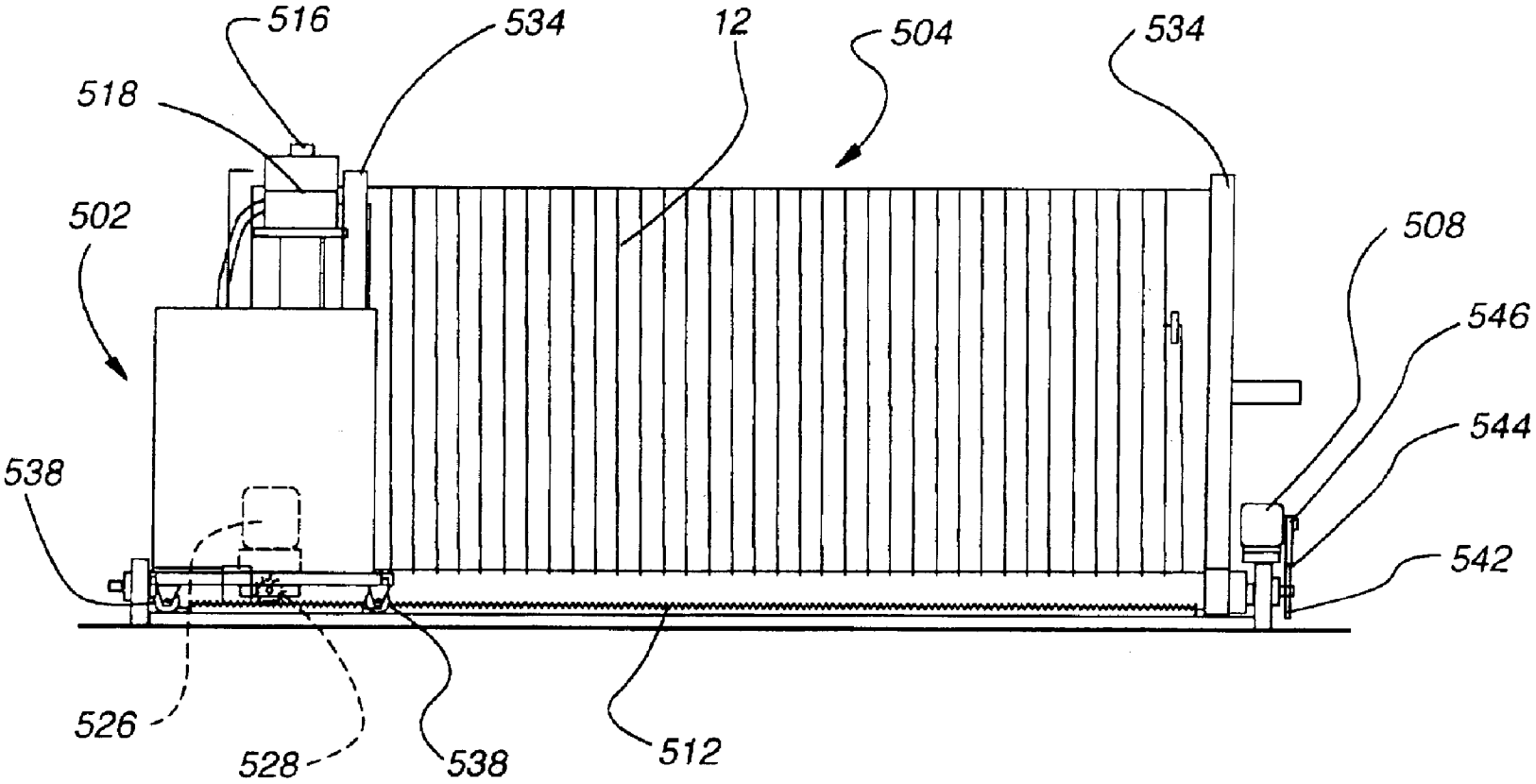
FIG. 40 is a side view of the second embodiment fabrication apparatus.
Figure 41:
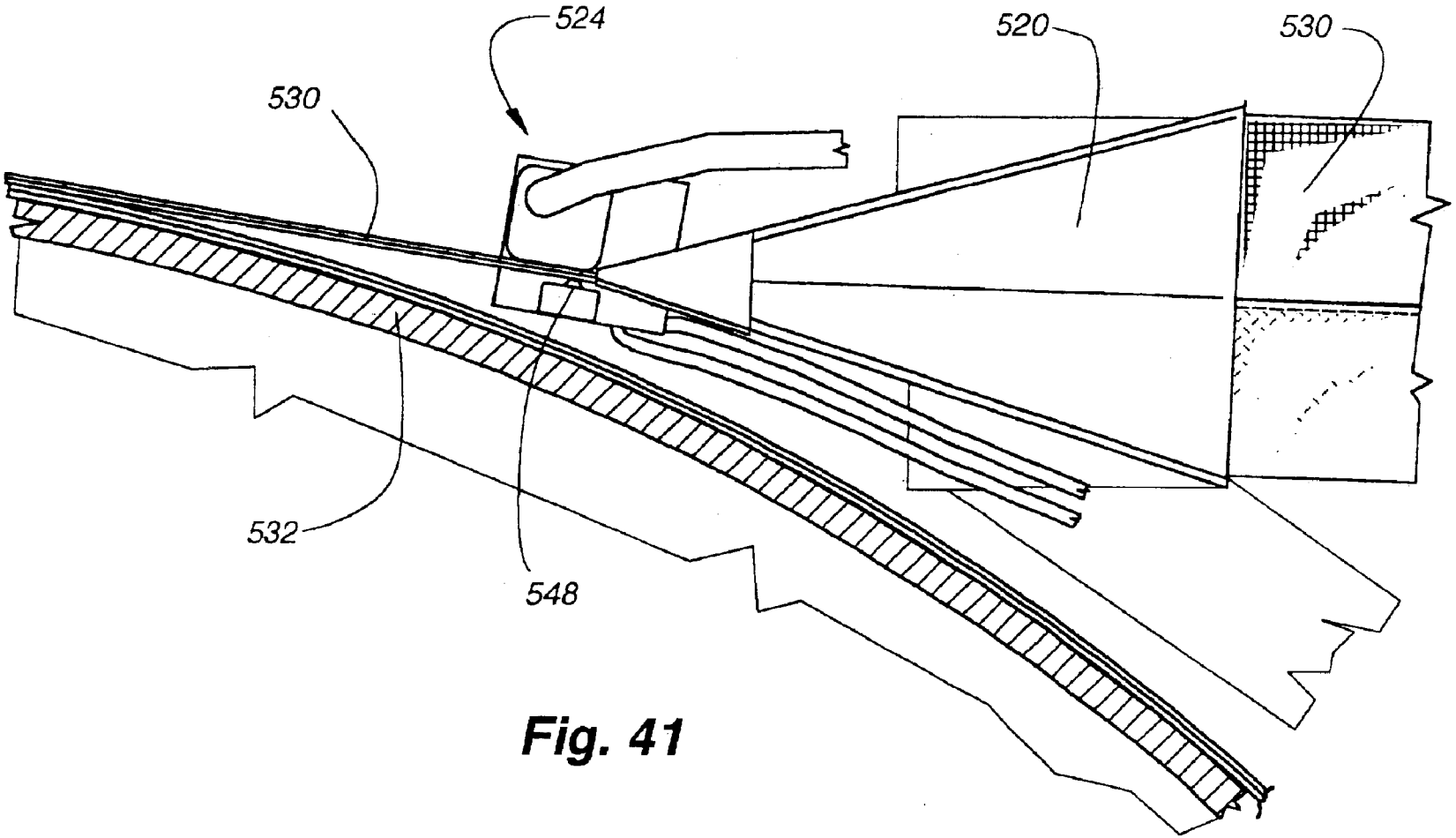
FIG. 41 is a side view of the folding horn and the adhesive applicator for the second embodiment fabrication apparatus as viewed along line 41—41 of FIG. 39.

The base 506 is best shown in FIGS. 38, 39 and 40. The base has a pair of parallel recessed tracks 510 that extend substantially the entire length of the base in a direction parallel to the drum 504. The wheels 538 of the wheeled base 514 of the cart 502 are received in the tracks 510, which guide the cart as it moves along them. In-between the tracks, the rack 512 is secured to the base. The rack 512 interfaces with the pinion gear 528 of the cart's drive motor 526 and provides the mechanism by which the cart propels itself from one end of the drum to the other. As mentioned above, two elongated roller cylinders 536 are rotateably mounted on the base 506 at their axles 540. One of the axles of one of the roller cylinders has a pulley 542 attached to it. A drive belt 546 extends from the axle pulley 542 to a pulley 546 connected to the drive shaft of a drum drive motor 508 used to rotate the drum at a predetermined speed.

In one variation of the second alternative embodiment, the relationship between the speed of rotation of the drum and the linear speed of the cart is controlled mechanically based on the operating speeds of the respective drive motors 508 and 526, as well as, the gearing utilized with both motors. Accordingly, the fabrication apparatus can be configured such that the cart moves a certain linear distance for every rotation of the drum, thereby ensuring the proper overlap of the folded tapes 530. In another variation, both drive motors are coupled to a computerized controller that varies the speed of one drive motor based on the speed of the other in a proportional relationship necessary to apply the tape with the proper overlap. By using a controller that keys the speed of the cart drive motor to the speed of the drum drive motor, proportionality can be maintained during startup and slowdown.

Alternative Embodiments and Other Variations

It is to be appreciated that any number of variations to the fabrication apparatus can be made without deviating from the scope or intent of the invention. In this regard the illustrated and described embodiments are merely exemplary and not intended to limit the scope of the appended claims. For instance a bonding section 100 may be utilized that comprises only a single tape supply assembly for use with either rolls of previously joined fabric tape or "double wide" tape. In another variation springs may be utilized in place of the pneumatic cylinders in the tensioning mechanisms of the various sections. Further, the actual locations and the configurations of the tensioning mechanism might vary as would be obvious to one of ordinary skill in the art. In other variations, a servo motor other than the drum or conveyor belt servo motors may serve as the master utilized by the controller to synchronize the other servo motors. In yet another variation, the holt melt adhesive may be replaced with a thermoset adhesive with a curing device such as a heat gun or ultraviolet light source being provided somewhere on the apparatus to cure the adhesive. It is be appreciated that many other variations would be obvious to one of ordinary skill in the art given the benefit of this disclosure.

Throughout this specification and appended claims, directional terms such as, but not limited to, "front," back," "rear," "top," "bottom," "lateral," "longitudinal," "left," "right," "vertical," and "horizontal" have only been used to explain the relative relationships between various components and elements of the apparatus and the shade material and should be interpreted accordingly. For example, if apparatus of FIG. 1 was vertically disposed along a wall instead of on a ground surface, the directional relationships between the components of the system would be retained even though in an absolute sense certain elements such as the spindles 128–130 would no longer be vertical.

What is claimed is:

1. A pocketed fabric shade which can be rolled up, comprising:

a plurality of horizontally-extending fabric cells, each cell having a top and bottom side, at least one of which is partial as well as front and rear sides so as to define a substantially rectangular cross-section, and wherein adjacent cells are joined together with said partial top or bottom side of one cell secured to a bottom or top side respectively of an adjacent cell and one of said front and rear sides of said one cell secured to a front or rear side respectively of said adjacent cell.

2. The shade of claim 1 wherein said front and rear sides of each cell are made from a different fabric.

3. The shade of claim 2 wherein said front and rear sides of each cell are made from a different type of a fabric.

4. The shade of claim 1 wherein said front and rear sides of each cell are made from a different type of a fabric.

5. The shade of claim 2 wherein said rear side of each cell is made from a fabric having the capability of diffusing or blocking light.

6. The shade of claim 5 wherein said front side of each cell is made from an aesthetically pleasing fabric.

7. A pocketed fabric shade which can be rolled up, comprising:

a plurality of horizontal cells adjacently attached to each other, the cells comprising, a longitudinal front strip and a longitudinal back strip each having a top and a bottom, the bottom of said front strip is directly attached to and engaged with the bottom of said back strip; and the top of said front strip of one cell is attached to the bottom of the front strip of an adjacent cell and wherein the top of said back strip is attached to the back strip of said adjacent cell.

8. A pocketed fabric shade which can be rolled up, comprising:

a plurality of horizontal fabric cells attached to each other, the cells comprising a longitudinal front strip and a longitudinal back strip, wherein said front and back strips are folded longitudinally along bottom edges and are attached directly to and in engagement with each other; and wherein the top edge of said back strip is attached to the back strip of an adjacent cell near the bottom fold of the back strip of said adjacent cell; and wherein the top edge of said front strip is folded toward said back strip end attached to the folded bottom edge of the front strip of said adjacent cell.

9. A pocketed fabric shade which can be rolled up, comprising:

a plurality of horizontal fabric cells adjacently attached to each other, each cell comprising:

a longitudinal strip folded so as to define a front side, a bottom side, and a back side, said front side being attached to the front side of an adjacent cell and said back side being attached to the bottom side of said adjacent cell.

10. The shade of claim 9 wherein a top edge of said back side of a cell is folded toward said front side of said cell to define a location for attachment of said folded back side to said bottom side of said adjacent cell.

* * * * *